US007036281B2

(12) United States Patent
Stewart et al.

(10) Patent No.: US 7,036,281 B2
(45) Date of Patent: May 2, 2006

(54) MULTI-STORY MULTIPLE DWELLING COMPLEX WITH SEMI-PRIVATE GARAGE TO APARTMENT ENTRY AND EXIT PATHWAYS

(75) Inventors: Jerry W. Stewart, Dallas, TX (US); W. Bryan Thruston, Dallas, TX (US)

(73) Assignee: S&T Joint Venture, Dallas, TX (US)

( * ) Notice: Subject to any disclaimer, the term of this patent is extended or adjusted under 35 U.S.C. 154(b) by 80 days.

(21) Appl. No.: 10/081,412

(22) Filed: Feb. 22, 2002

(65) Prior Publication Data

US 2002/0073637 A1 Jun. 20, 2002

Related U.S. Application Data

(63) Continuation-in-part of application No. 09/685,675, filed on Oct. 10, 2000, now Pat. No. 6,405,496.

(51) Int. Cl.

| | |
|---|---|
| ***E04H 1/00*** | (2006.01) |
| ***E04H 14/00*** | (2006.01) |
| ***E04H 3/00*** | (2006.01) |
| ***E04H 5/00*** | (2006.01) |
| ***E04H 6/00*** | (2006.01) |

(52) U.S. Cl. ..... 52/236.3; 52/185; 52/79.2; 52/169.4; 52/169.9

(58) Field of Classification Search ..... 52/185, 52/236.1, 169.4, 79.1, 236.3, 169.3, 169.9, 52/175, 236.5, 79.2, 174, 234

See application file for complete search history.

(56) References Cited

U.S. PATENT DOCUMENTS

| | | | |
|---|---|---|---|
| 2,698,973 | A | 1/1955 | Zeckendorf et al. |
| 3,479,781 | A | 11/1969 | Johnson |
| 3,603,047 | A | 9/1971 | Tournier |
| 3,656,266 | A | 4/1972 | Tylius |

(Continued)

OTHER PUBLICATIONS

"Building With Outinord" (Outinord Universal, Inc. Website), © 1999, 6 pages.

(Continued)

*Primary Examiner*—Carl D. Friedman
*Assistant Examiner*—Chi Q. Nguyen
(74) *Attorney, Agent, or Firm*—Gardere Wynne Sewell, LLP

(57) ABSTRACT

A multistory apartment building complex may comprise vertically stacked modules and includes one or more vehicle parking levels grade and one or more dwelling unit levels vertically stacked above the vehicle parking levels. At least one of the parking levels includes private garages for at least selected ones of the dwelling units and occupants of the selected dwelling units may move between their own garage and their dwelling unit via an elevator extending directly to the individual dwelling units on each level. The elevators may also serve plural dwelling units on each dwelling unit level. A service corridor is provided on selected dwelling unit levels which may be accessed by a service elevator or spaced apart stairways to provide secondary access between each dwelling unit on each dwelling unit level and street level. Each dwelling unit may include a small service room having a lockable door between the service room and the dwelling unit and a door opening to the service corridor.

43 Claims, 24 Drawing Sheets

U.S. PATENT DOCUMENTS

| | | | |
|---|---|---|---|
| 3,750,354 | A | 8/1973 | Boros |
| 3,755,974 | A | 9/1973 | Berman |
| 4,003,182 | A | 1/1977 | Wokas |
| 4,596,097 | A | 6/1986 | Stewart et al. |
| 4,602,464 | A | 7/1986 | Medel |
| 4,918,889 | A | 4/1990 | Lundstrom et al. |
| 5,109,642 | A | 5/1992 | Ayala et al. |
| 5,809,704 | A | 9/1998 | Stewart et al. |
| 6,058,664 | A | 5/2000 | Brownlee, III |
| 6,155,012 | A | 12/2000 | Halbitte |
| 6,405,496 | B1 * | 6/2002 | Stewart et al. ..... 52/185 |

OTHER PUBLICATIONS

"Simply Remarkable High-Rise Living" (Excelsiorliving.com Website), © 2000, 7 pages, Genesis Real Estate.

Carlton Dunes, Amelia Island, FL, floor plans, 2 sheets, date unknown.

* cited by examiner

MULTI-STORY MULTIPLE DWELLING COMPLEX WITH SEMI-PRIVATE GARAGE TO APARTMENT ENTRY AND EXIT PATHWAYS

CROSS REFERENCE TO RELATED APPLICATION

This application is a continuation-in-part of U.S. patent application Ser. No. 09/685,675, filed Oct. 10, 2000 now U.S. Pat. No. 6,405,496.

BACKGROUND

The continuing demand for multi-story or so-called high-rise multiple dwelling structures, such as apartment and condominium building complexes, together with the need to provide space for parking private automotive vehicles on the premises of such structures or complexes has brought about the desire to construct such complexes in a way that occupants of the respective dwelling units or apartments have at least a semi-private path between a private parking space or garage for their vehicle, or vehicles, and their residential dwelling unit. In this way persons living in high-rise buildings can enjoy privacy similar in some respects to detached single family dwelling structures with private garages. Due at least in part to the cost of land in locations where multi-story, multiple dwelling building complexes are needed and desired, the space available for private vehicle parking is, of course, somewhat limited and completely private or even semi-private pathways between a person's vehicle parking space or garage and their own residential dwelling unit has heretofore been difficult to provide.

U.S. Pat. No. 4,596,097, issued Jun. 24, 1986, and U.S. Pat. No. 5,809,704, issued Sep. 22, 1998, provide improvements in multiple dwelling structures arranged with vehicle garages to provide private access or pathways between each garage and each dwelling unit. However, multi-story condominium or apartment buildings with heights of three or more stories, containing multiple floors or "levels" of separate dwelling units, and which have at least semi-private pathways between vehicle garage or parking areas and each dwelling unit, have not been developed. It is to these ends that the present invention has been provided.

SUMMARY OF THE INVENTION

The present invention provides improvements in multi-story, multiple dwelling apartment or condominium building complexes. In accordance with one aspect of the invention multi-story, multiple dwelling unit building complexes are provided which include motor vehicle storage areas comprising private vehicle garages or parking areas and at least semi-private pathways between each garage or parking area and a dwelling unit associated with such garage or parking area. The present invention also provides a multi-story, multiple dwelling complex with a unique arrangement of vehicle storage including parking spaces or garages on one or more lower levels of the complex and one or more elevators between the garage level or levels and opening directly to one or more dwelling units on each dwelling unit level. The garage level(s) may include semi-private garage level corridors and multiple semi-private elevators between the garage level(s) and the multiple residential dwelling levels, and private entrances to residential dwelling units at each level by way of such elevators.

The present invention further provides unique floor plans for a multi-story, multiple dwelling unit building complex which provide for multiple dwelling units on each floor or level with respective private entrances, together with alternate pathways between each dwelling unit and a lower or "street" level of the building complex. The alternate pathways may include a second elevator and one or more stairways in accordance with regulatory requirements, for example. The configuration of the multiple dwelling units on each level of a multi-story structure in accordance with the invention may also provide for a common corridor on each or selected levels for service personnel, including delivery and pickup services, which corridors also provide alternate entry or exit pathways for each dwelling unit.

The present invention further provides a multi-story, multiple dwelling unit building complex with dwelling units at selected levels which are arranged such that a service room may be provided for each dwelling unit which has access from and is lockable from the interior of the dwelling unit. Each service room is also accessible from a common service corridor whereby service personnel may have access to the respective service rooms of each dwelling unit for pickup and delivery services, for example.

Still further, the invention provides a multiple dwelling building complex with improved arrangements of multiple dwelling units which may occupy one or more levels and may be configured to take advantage of an aesthetically pleasing view from at least one side of each dwelling unit.

The present invention also provides a unique configuration of a multi-story building which is adapted for mixed use, including commercial or retail merchant facilities, and also includes multiple floors or building levels which are provided with one or more dwelling units each. All dwelling units also have access to the commercial or retail merchant facilities as well as to one or more levels which include respective vehicle garages associated with each dwelling unit.

Those skilled in the art will further appreciate the above-mentioned advantages and superior features of the invention together with other important aspects thereof upon reading the detailed description which follows in conjunction with the drawings.

DETAILED DESCRIPTION OF PREFERRED EMBODIMENTS

Figure 1:
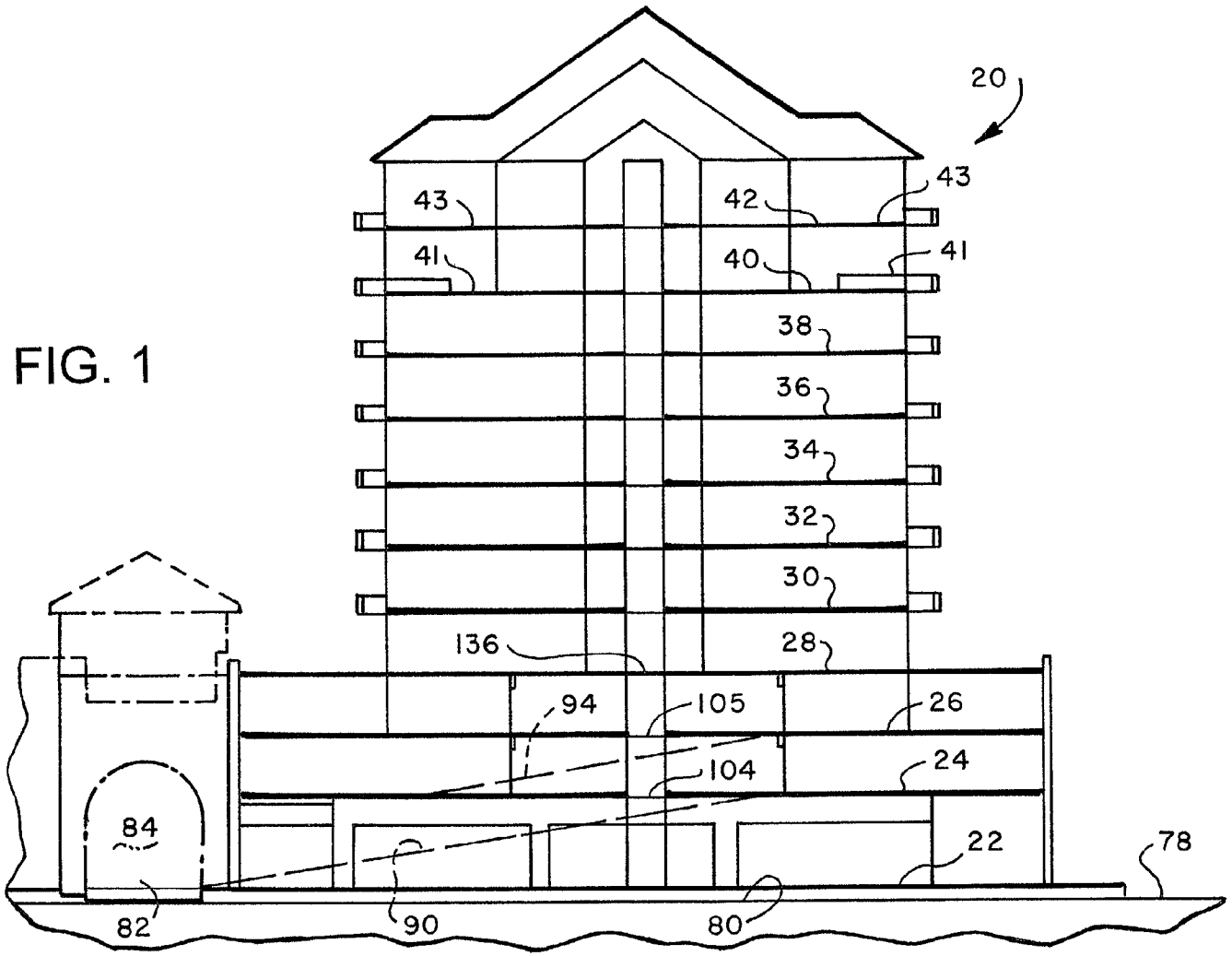
FIG. 1 is a somewhat schematic section view of a multi-story, multiple dwelling building complex in accordance with the present invention and taken generally from line 1—1 of FIG. 2.

In the description which follows like elements are marked throughout the specification and drawing with the same reference numerals, respectively. The drawing figures are not necessarily to scale and many features of conventional configuration and construction may be shown in somewhat generalized or schematic form in the interest of clarity and conciseness.

Referring to FIG. 1, there is shown a generalized and somewhat schematic view of a multi-story, multiple dwelling building complex in accordance with the invention and generally designated by the numeral 20. The building complex 20, which may be of a selected height in accordance with the number of floor levels or stories required, is indicated as an eleven story building, including the ground or first floor level 22. The building complex 20 includes plural garage floors or levels, two shown by way of example, and indicated at numerals 24 and 26. A first level of multiple dwellings is indicated at 28, comprising the fourth floor of the building and floors five through nine are indicated by numerals 30, 32, 34, 36 and 38, respectively. The residential dwelling unit layouts of levels five through nine are substantially identical and generally of the configuration of the dwelling units at the fourth level 28, which will be described in further detail herein. Tenth and eleventh floors, indicated by numerals 40 and 42, respectively, may have different dwelling unit floor plans so as to provide opposed exterior decks 41 and 43, for example. However, the dwelling units at levels 40 and 42 also enjoy the basic advantages of the present invention. FIG. 1 is intended to illustrate the general arrangement of the building complex 20. Accordingly, the exterior details of the building complex 20 are not illustrated and each floor level is indicated in bold to emphasize it as a particular structural feature.

As further shown in FIG. 1, the first floor level 22, which is indicated to be essentially street level, may not occupy all of the footprint allocated to the building complex 20. The building complex 20, as well as the other embodiments disclosed herein, may be constructed using various techniques. One preferred technique is a reinforced concrete structure wherein each level is constructed somewhat as a generally rectangular box-like concrete "tunnel" using one or more methods known to those of skill in the art and practiced by Outliner Universal, Inc. and as described in some detail in U.S. Pat. Nos. 3,979,919; 4,261,542 and 4,439,064 and U.S. Pat. No. 5,809,704 issued Sep. 22, 1998 to Stewart, et al. The subject matter of U.S. Pat. Nos. 3,979,919; 4,261,542; 4,439,064 and 5,809,704 is incorporated herein by reference. The methods described in the above-mentioned patents may be enhanced by enclosing the tunnel forms temporarily and heating the enclosed environment to accelerate drying and curing of the concrete.

Figure 2:
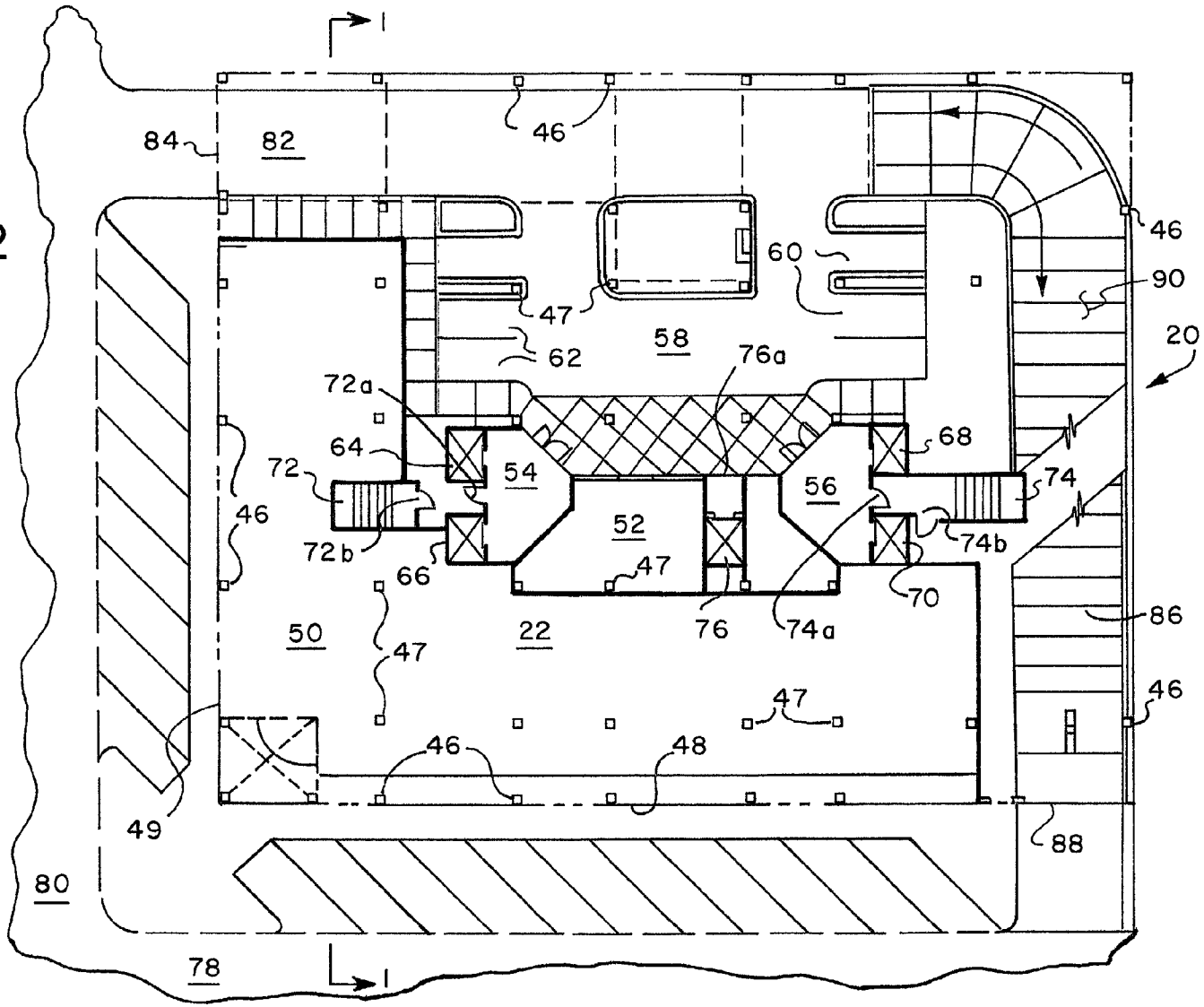
FIG. 2 is a plan view of the ground or first floor level of the multi-story building complex shown in FIG. 1.

Alternatively, or in addition to the tunnel form methods, the building complex 20 may be constructed of plural vertically extending columns 46, FIG. 2, about the perimeter of the complex and interior columns 47, all of which support the floors or levels 24, 26, 28 etc. above the level 22. Other construction techniques known to those of skill in the art may be employed while enjoying benefits of the present invention. As shown by the plan view of FIG. 2, exterior walls 48, 49 may enclose a large space dedicated to retail merchant shops, indicated at numeral 50. Other facilities at floor level 22 may include a management or leasing office 52 and spaced apart lobbies 54 and 56 opening to a covered driveway 58 and visitor vehicle parking places 60 and 62, for example.

The lobbies 54 and 56 open into respective elevators, with elevators 64 and 66 opening into lobby 54 and elevators 68 and 70 opening into lobby 56. Additionally, stairways 72 and 74 descend to the floor level 22 and have access through doorways 72*a*, 72*b*, for stairway 72 and doorways 74*a* and 74*b* for stairway 74. Still further, a service elevator 76 is accessible from floor level 22 through a doorway 76*a*.

In one exemplary arrangement of the building complex 20, it is situated at an intersection of streets or roadways 78 and 80 and access to the parking garage level 24, as well as level 26, is by way of a driveway 82 which enters the complex 20 at opening 84, FIGS. 1 and 2. Still further, subterranean parking levels or other vehicle accessible portions of the building complex 20 may be accessed by way of a driveway 86, FIG. 2, through an opening 88. Driveway 82 is connected to an inclined two-way vehicle ramp 90, FIGS. 1 and 2, which opens onto garage level 24, see FIG. 3 also.

Figure 3:
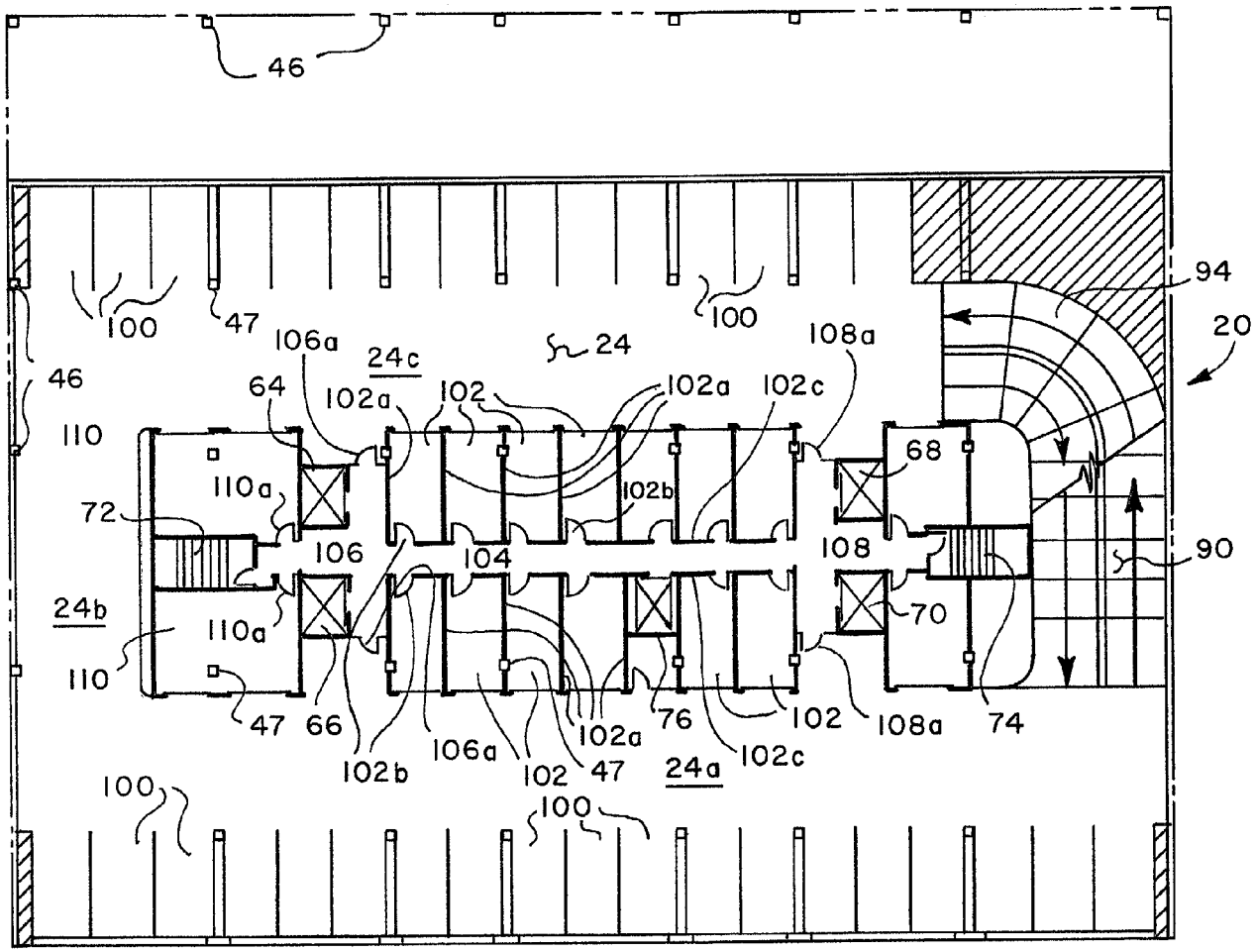
FIG. 3 is a plan view of the second floor and first garage level of the building complex shown in FIG. 1.
Figure 4:
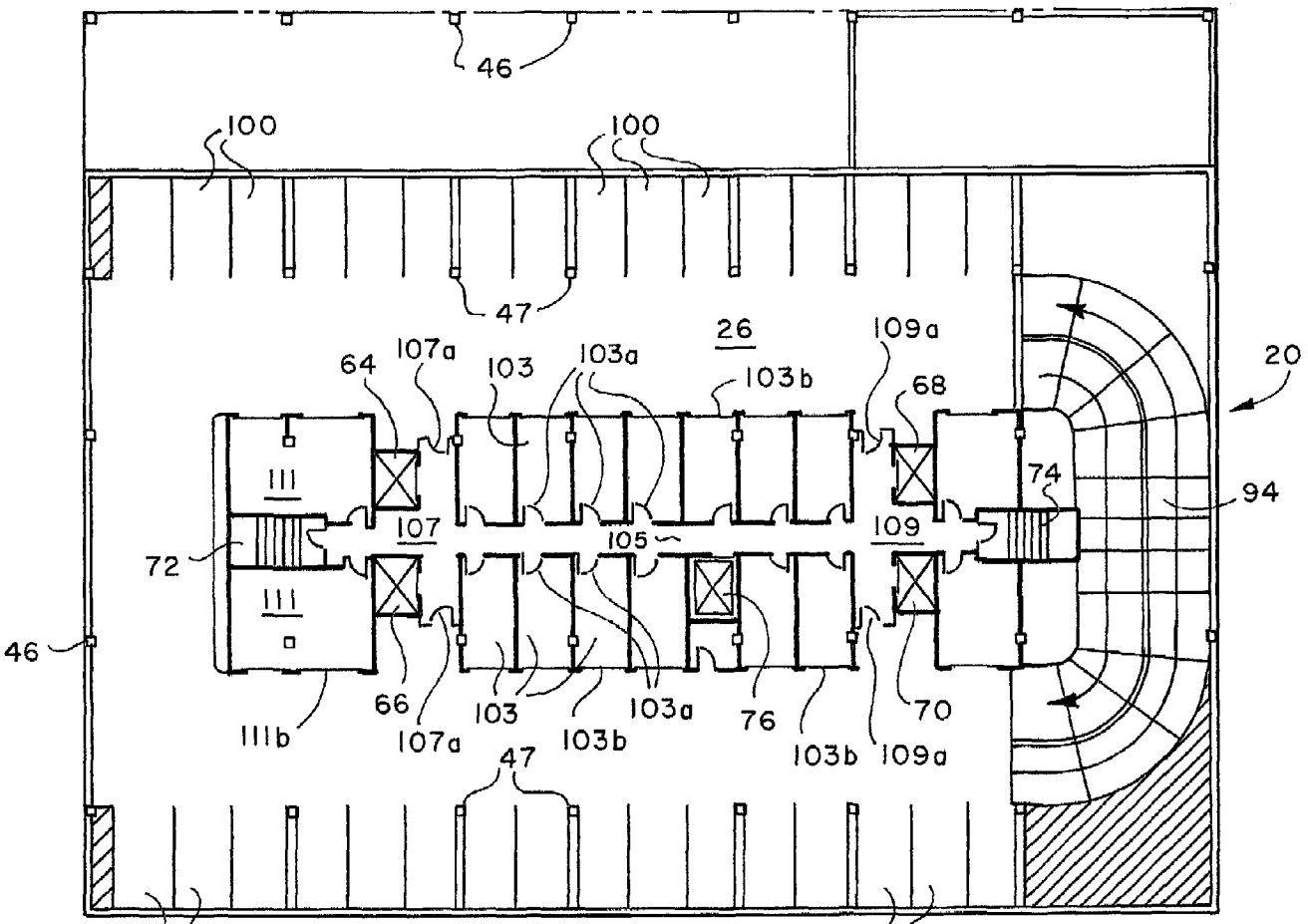
FIG. 4 is a plan view of the third floor and second garage level of the building complex shown in FIG. 1.

In like manner, an inclined two-way vehicle ramp 94, FIGS. 1, 3, and 4 provides access between garage level 26 and garage level 24.

Referring to FIG. 3, vehicle parking and garage level 24 comprises a parking deck with side-by-side vehicle parking spaces 100, for example, disposed on opposite sides of the complex 20, as shown. A somewhat C-shaped or U-shaped driveway 24*a*, 24*b*, 24*c* extends between ramps 90 and 94 at level 24 and substantially surrounds two sets of back-to-back arranged enclosed garages 102 which are separated by suitable parallel, spaced apart partitions or sidewalls 102*a*. Garages 102 each include an interior opening or doorway 102*b* in respective interior or rear walls 102*c* and which open to an interior pedestrian pathway or corridor 104. Corridor 104 extends between foyers 106 and 108 which open to the elevators 64, 66, 68, and 70, as shown in FIG. 3. Foyer 106 also opens to stairway 72 and foyer 108 opens to stairway 74. The term garage as used herein may include an enclosure with a roof, a rear wall, opposed sidewalls and a door for the vehicle entrance. However, the term garage may also include a vehicle parking space in which one or more of the aforementioned components has been eliminated. The garages may be arranged in various ways relative to each other and pedestrian pathways. Preferred garage configurations and arrangements are described in some detail herein.

As shown in FIG. 3, foyers 106 and 108 also open to the parking deck of garage level 24 through doorways 106*a* and 108*a*. In this way, persons parking a vehicle in parking spaces 100 or in the respective garages 102 and 110 may enter and exit the foyers 106 and 108 through the doorways 106*a* and 108*a*. The garage levels or parking decks shown in FIGS. 4, 7, 9, 11, 13 and 14 provide similar arrangements of access between parking spaces or garages and the elevator foyers shown in the respective drawing figures.

As further shown in FIG. 3, certain ones of garages on level 24 may be multiple vehicle garages, such as the back-to-back garages 110, for example. These garages open by way of doorways 110*a* to foyer 106, for example. Accordingly, occupants of a dwelling unit on one of levels 28, 30, 32, 34, 36, 38, 40 and 42 may have access to a garage 102 or 110 by way of an elevator 64, 66, 68 or 70. Service elevator 76 also opens to corridor 104 as shown in FIG. 3.

Referring now to FIG. 4, the parking deck or garage level 26 also includes plural partially open or completely open vehicle parking spaces 100 extending along opposite longitudinal sides of the building complex 20. Plural garages 103 and 111, are also arranged in back to back configuration and including pedestrian openings into a central corridor 105, via respective openings 103*a*. Garages 111 open into a foyer 107 for elevators 64 and 66, which foyer is also in communication with the corridor 105. In like manner a foyer 109 is in communication with elevators 68 and 70, and the other end of corridor 105. Stairways 72 and 74 are also accessible to the respective foyers 107 and 109 as illustrated in FIG. 4. Each of the garages on levels 24 and 26 is provided, preferably, with a vehicle entrance door, such as the doors 103*b* and 111*b* for the garages 103 and 111. Entrance and exit doorways 107*a* and 109*a* provide access between the parking deck at parking level 26 and the foyers 107 and 109, respectively.

Accordingly, a second garage level and parking deck is provided for the building complex 20. Those skilled in the art will appreciate that only one or substantially more than one parking level may be provided, depending on the need for vehicle parking spaces and private garages, as provided for the complex 20 by the parking levels 24 and 26. Still further, those skilled in the art will also appreciate that the parking levels 24 and/or 26 may be at any level of the complex 20, including below grade, while enjoying the benefits of the arrangement of private garages, a central corridor and elevators which are accessible to the garages for movement between a garage and a dwelling unit on another level and associated with that garage.

Figure 5:
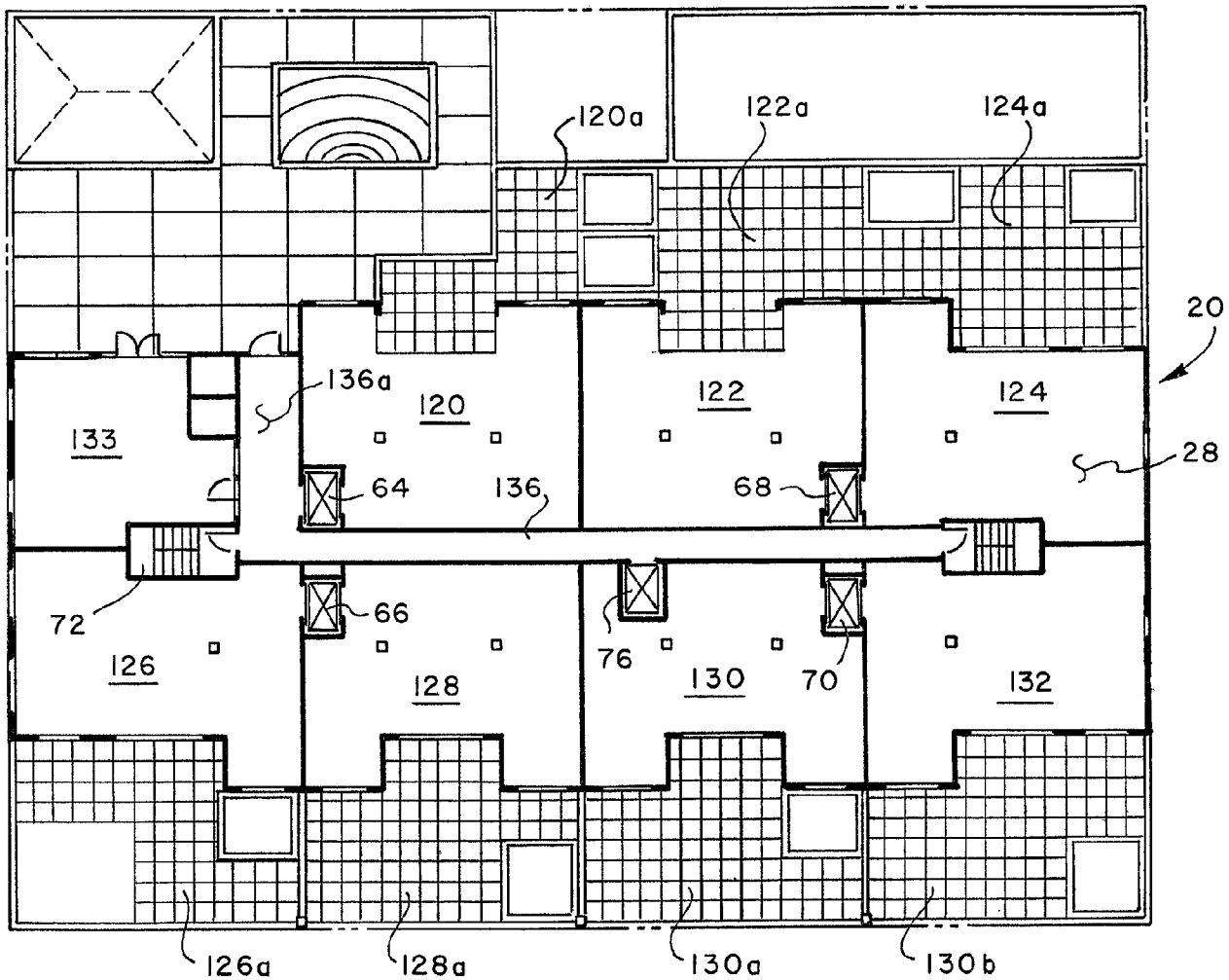
FIG. 5 is a plan view of the fourth floor and comprising the first level having multiple dwelling units thereon, of the building complex shown in FIG. 1.

Referring now to FIG. 5, the fourth floor of building complex 20, also designated as level 28, is provided with multiple dwelling units shown generally at 120, 122, 124, 126, 128, 130 and 132. A separate unit 133, which may also be a residential dwelling unit, is shown by way of example as a common use facility, such as club room or exercise room. Dwelling units 120, 122, 124, 126, 128, 130 and 132 each open onto deck or plaza areas which may be separated according to dwelling units by suitable partition means. Each plaza or deck is designated by numeral 120*a*, 122*a*, 124*a*, etc. The large plazas or decks for the dwelling units of level 28 are omitted at levels 30, 32, 34, 36 and 38, as indicated by the section view of FIG. 1. Each dwelling unit level, such as level 28, has a single longitudinal central service corridor, indicated by numeral 136 in FIG. 5. Service corridor 136 extends between and is accessible to stairways 72 and 74, as shown. Service elevator 76 is also accessible to corridor 136.

As further shown in FIG. 5, elevator 64 is accessible to dwelling unit 120 and to branch service corridor 136*a* and common use room 133. Elevator 64 may be accessed on levels 30, 32, 34, 36, 38, 40 and 42 only to adjacent dwelling units on each of those levels, for example. In like manner, elevator 66 is accessible on level 28 (and levels 30, 32, 34, 36, 38, 40 and 42) to dwelling units on opposite sides of the elevator, such as dwelling units 126 and 128 at level 28. Still further, elevator 68 is operable to provide direct access to dwelling units 122 and 124 on level 28 and elevator 70 is operable to provide only access directly between the elevator and dwelling units 130 and 132 on level 28. As mentioned previously, elevators 64, 66, 68 and 70 are operable to serve only one or two dwelling units at level 28 as well as each of the levels above level 28.

Accordingly, by way of example, persons occupying dwelling units 126 and 128 may have a garage on level 24 or 26, for example, and a pathway between garages associated with dwelling units 126 and 128 and the respective dwelling units is provided by elevator 66. Elevators 64, 66, 68 and 70 may be operable by persons authorized to do so by way of a control system, not shown, operated by a keypad or a mechanical key, for example. Thus, a resident of dwelling unit 126 and having a garage 102 at level 24 has a pathway between said garage and said dwelling unit which includes corridor 104, foyer 106 and elevator 66. Of course, persons living on other levels in dwelling units directly over or under dwelling unit 126 also have access to their dwelling unit and one of the parking levels 24 or 26 by way of elevator 66. Similar access pathways are provided for dwelling units 120, 122, 124, 128, 130, and 132, as will be appreciated by those skilled in the art. For example, occupants of dwelling units 122 and 124 have access to the respective parking levels and their respective garages by way of elevator 68, and occupants of dwelling units 130 and 132 have access between their parking garages, on either level 24 or 26, by way of elevator 70.

In the event of malfunction or loss of power to any of the elevators 64, 66, 68 or 70, an occupant of a dwelling unit or the common use area on level 28 may exit from or have access to that level by way of one of stairways 72 or 74 and corridor 136, 136*a*. Still further, a secondary elevator exit or access path may be provided by elevator 76 and corridor 136 for all dwelling units on level 28. The same or an equivalent arrangement of elevator access, service corridors and stairways is provided for each dwelling unit level of the building complex 20. Suitable doorways between each of the dwelling units and the service corridor 136 on level 28 must, of course, be provided. A preferred arrangement for pedestrian access between corridor 136 and a dwelling unit on level 28 will now be described herein in conjunction with FIG. 6.

Figure 6:
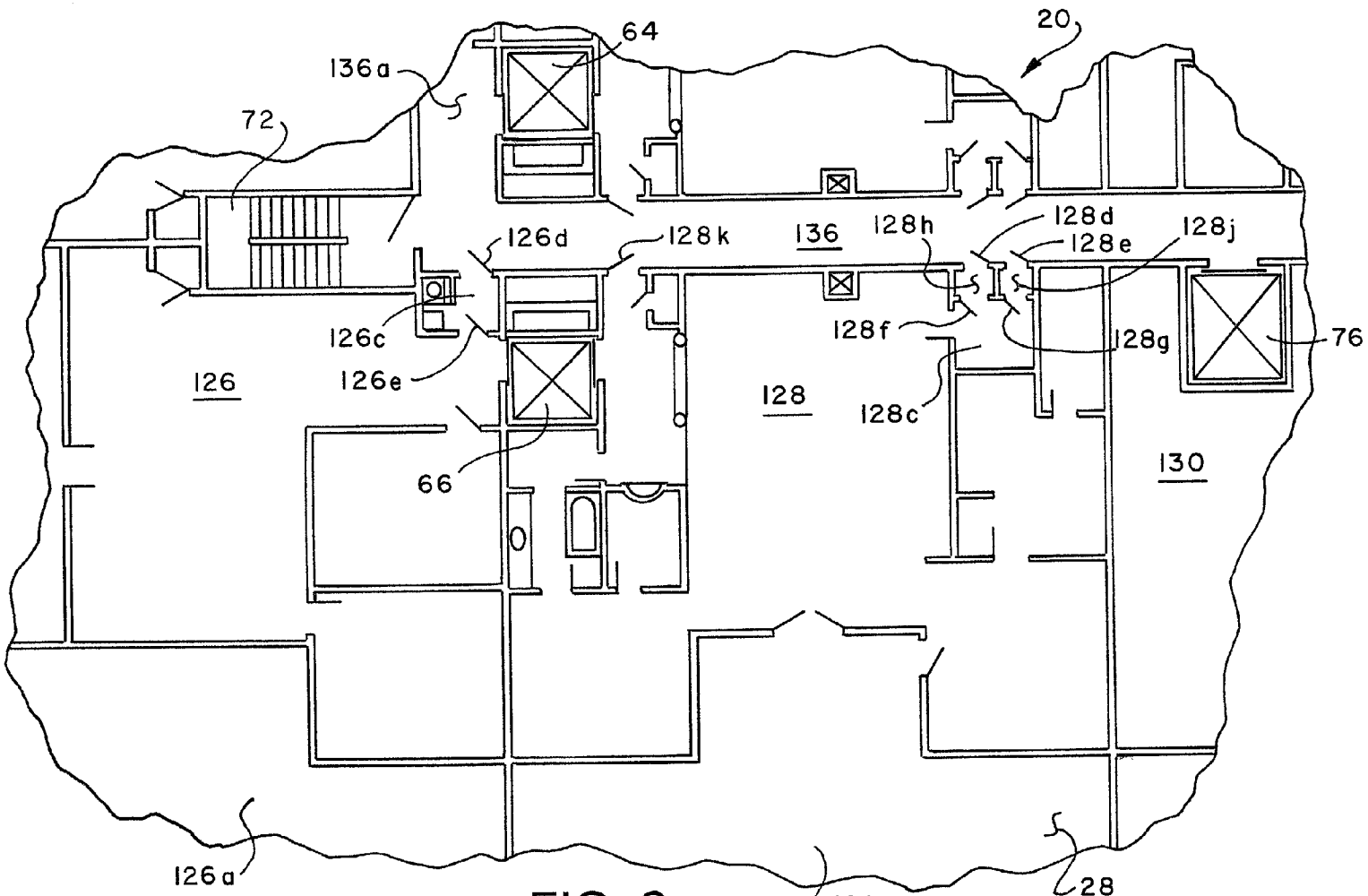
FIG. 6 is a floor plan of portions of two adjacent dwelling units on a larger scale, and typical of the dwelling units of the building complex of FIG. 1.

Referring now to FIG. 6, there is shown a more detailed plan view of dwelling unit 128 and a portion of dwelling unit 126. In a preferred arrangement for providing pedestrian access between corridor 136 and dwelling units 126 and 128, each of these dwelling units may have a lockable service room, such as room 126*c* for dwelling unit 126, and lockable service room 128*c* for dwelling unit 128. Room 126*c* is provided with a single door 126*d* opening to corridor 136. Door 126*d* may be lockable, but is normally left unlocked. Room 126*c* also includes a lockable doorway and door 126*e* opening into the interior of dwelling unit 126. Door 126*d* may be left unlocked in room 126*c* to allow service personnel to make deliveries and pickups by accessing corridor 136 via the service elevator 76, or stairways 72 or 74.

In like manner, dwelling unit 128 may include a service room 128*c* which is provided with double doors 128*d* and 128*e* opening from corridor 136 into storage spaces which are also accessible by lockable interior doors 128*f* and 128*g*, respectively. Separate service pickup and delivery compartments 128*h* and 128*j* are provided by the sets of doors 128*d*, 128*f*, and 128*e*, 128*g* which may be accessible, respectively, for refuse pickup or other items to be picked up or delivered, respectively. Door 126*e*, as well as doors 128*f* and 128*g* are, of course, lockable from the interior of the respective dwelling units 126 and 128, and thus, the associated service or utility rooms may be used as an exit path from each of the dwelling units 126 and 128 in the event that the elevator 66 is inoperable, for example. In this way, persons occupying dwelling units on any one level of the complex 20 may have access to a central service corridor and the stairways 72 and 74 as well as service elevator 76. Service rooms, such as rooms 126*c* and 128*c*, may be eliminated in one or more dwelling units on each dwelling unit level. Of course, in an emergency wherein power is not available to elevator 76, persons may exit or access the building only via the stairways. As shown by way of example for dwelling unit 128, a second interior access point may be provided by an entrance/exit door 128*k* opening to corridor 136.

Accordingly, the building complex 20 advantageously provides private or at least semi-private access or pathways between respective dwelling units on all or selected levels of the complex and associated parking garages for convenience, security and privacy purposes. Still further, the arrangement of the dwelling units, service corridors, stairways, and service elevators on each of the levels which include residential dwelling units provides requisite alternate exit and entry pathways if the semi-private elevators are not functional. Still further, the clustered private garages which open into a securable interior corridor also enhance the security and privacy aspects of the building complex 20 for the benefit of its occupants. Lastly, the unique service rooms 126*c* and 128*c*, shown by way of example in FIG. 6 for their respective dwelling units, also provide secure yet convenient access to the central service corridors at each level.

Figure 7:
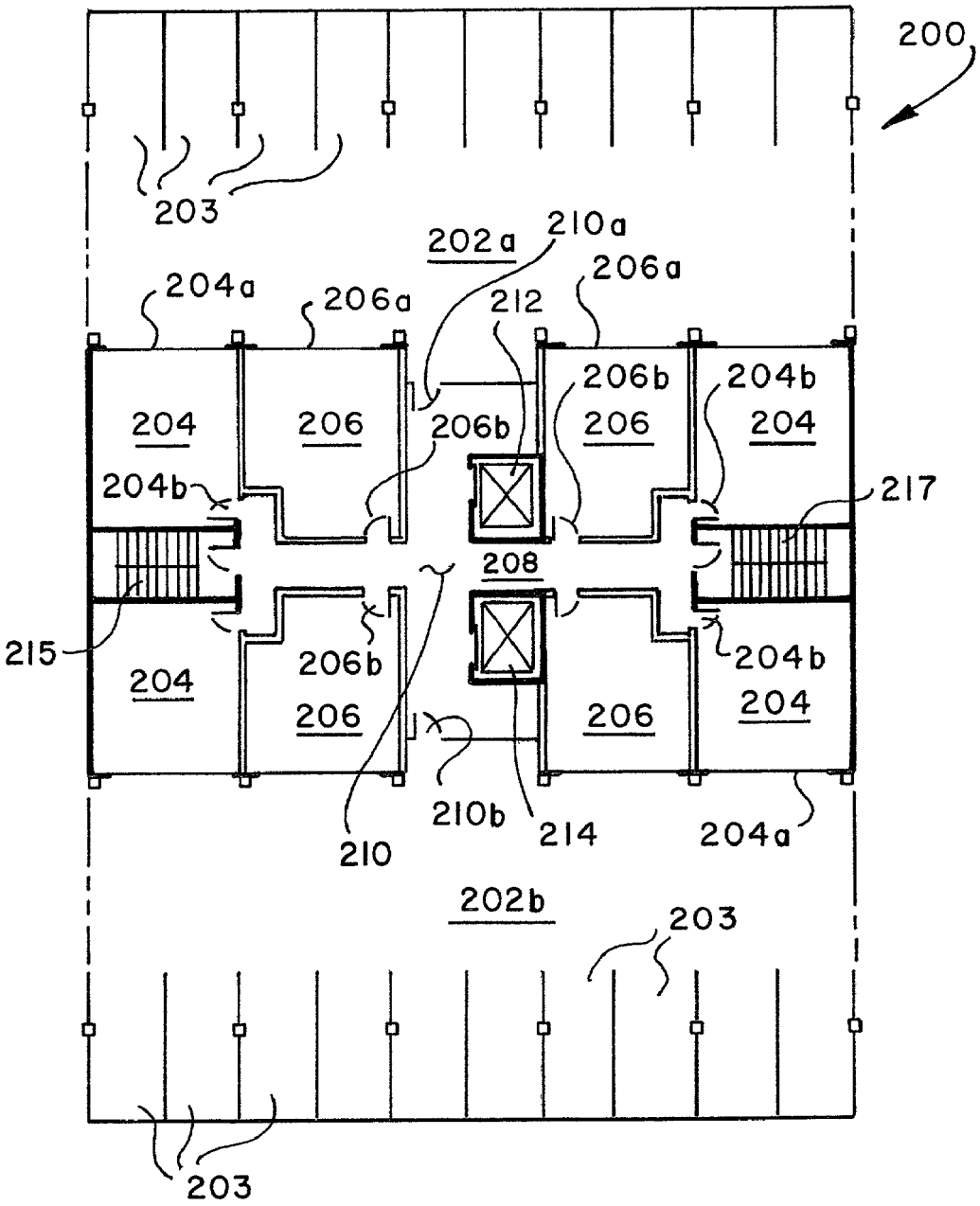
FIG. 7 is a plan view of a garage level of a multi-story multiple building complex in accordance with a first alternate embodiment of the present invention.
Figure 8:
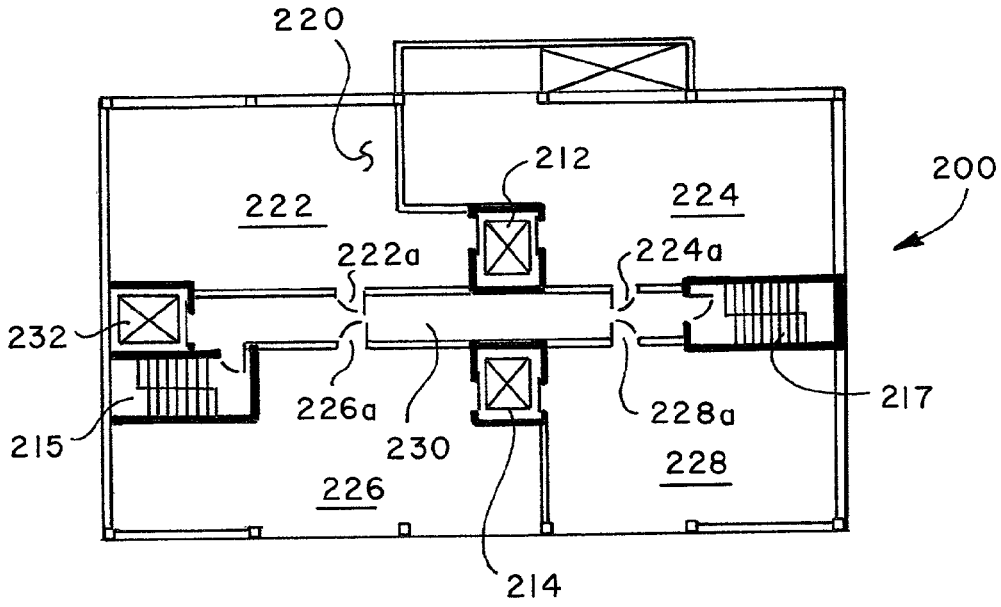
FIG. 8 is a plan view of a dwelling unit floor or level of the building complex which includes the garage level of FIG. 7.

Referring now to FIGS. 7 and 8, certain details of a first alternate embodiment of a multi-story multiple dwelling building complex in accordance with the invention are illustrated. FIG. 7 illustrates a building complex 200 including an exemplary vehicle parking level which may, for sake of discussion, be at street level. Accordingly, vehicle parking level 202 includes driveway parts 202*a* and 202*b* on opposite sides of centrally disposed clustered garages 204 and 206 arranged back to back, as illustrated. Garages 204 have vehicle and pedestrian openings 204*a* and pedestrian only openings 204*b*, each including respective doors. Garages 206 include vehicle and pedestrian openings 206*a* and pedestrian only openings 206*b*, each including respective doors. Openings 204*b* and 206*b* open into central corridor 208 which is intersected by an interior corridor or foyer 210 having access to spaced apart elevators 212 and 214. Pedestrian entries to the foyer 210 from the parking level 202 may also be provided at doorways or openings 210*a* and 210*b*. Corridor 208 also opens at opposite ends thereof to respective stairways 215 and 217.

Referring now to FIG. 8, there is illustrated an exemplary dwelling unit level 220 for the building complex 200 including four residential dwelling units 222, 224, 226 and 228. Elevator 212 services or provides access to dwelling units 222 and 224 while elevator 214 provides access to dwelling units 226 and 228. Elevators 212 and 214 may provide access to corresponding dwelling units on other levels of the complex 200. A central service corridor 230 extends between stairway 217 and an offset portion of stairway 215 to provide a space for a service elevator 232. Service elevator 232 may extend between each of plural dwelling unit levels corresponding to level 220 and a second mezzanine level, not shown, for example, but accessible to service workers. Access between corridor 230 and each of the dwelling units 222, 224, 226 and 228 may be via doorways and doors 222*a*, 224*a*, 226*a* and 228*a*, respectively.

Accordingly, the building complex 200 provides essentially the same advantages and conveniences as the complex 20 in that a garage at garage level 202 may be associated with a dwelling unit at level 220 whereby a person, for example, parking a vehicle in one of garages 204 or 206 may enter corridor 208 through a doorway 204*b* or 206*b*, and access elevator 212 and dwelling unit 224 by way of said elevator. In the event of a need for an emergency exit by way of service elevator 232 or stairways 215 and 217 the person or persons occupying any one of the residential dwelling units at level 220 may exit such dwelling unit into corridor 230 so that access may then be obtained to either one of the stairways or the service elevator. Those skilled in the art will recognize that the dwelling units 222, 224, 226 and 228 may include a service room similar to the service rooms 126*c* or 128*c*, for example. Accordingly, the building complex 200 enjoys all of the advantages of the complex 20 as will be recognized by those skilled in the art from reading the foregoing description in conjunction with FIGS. 7 and 8 of the drawings.

Figure 9:
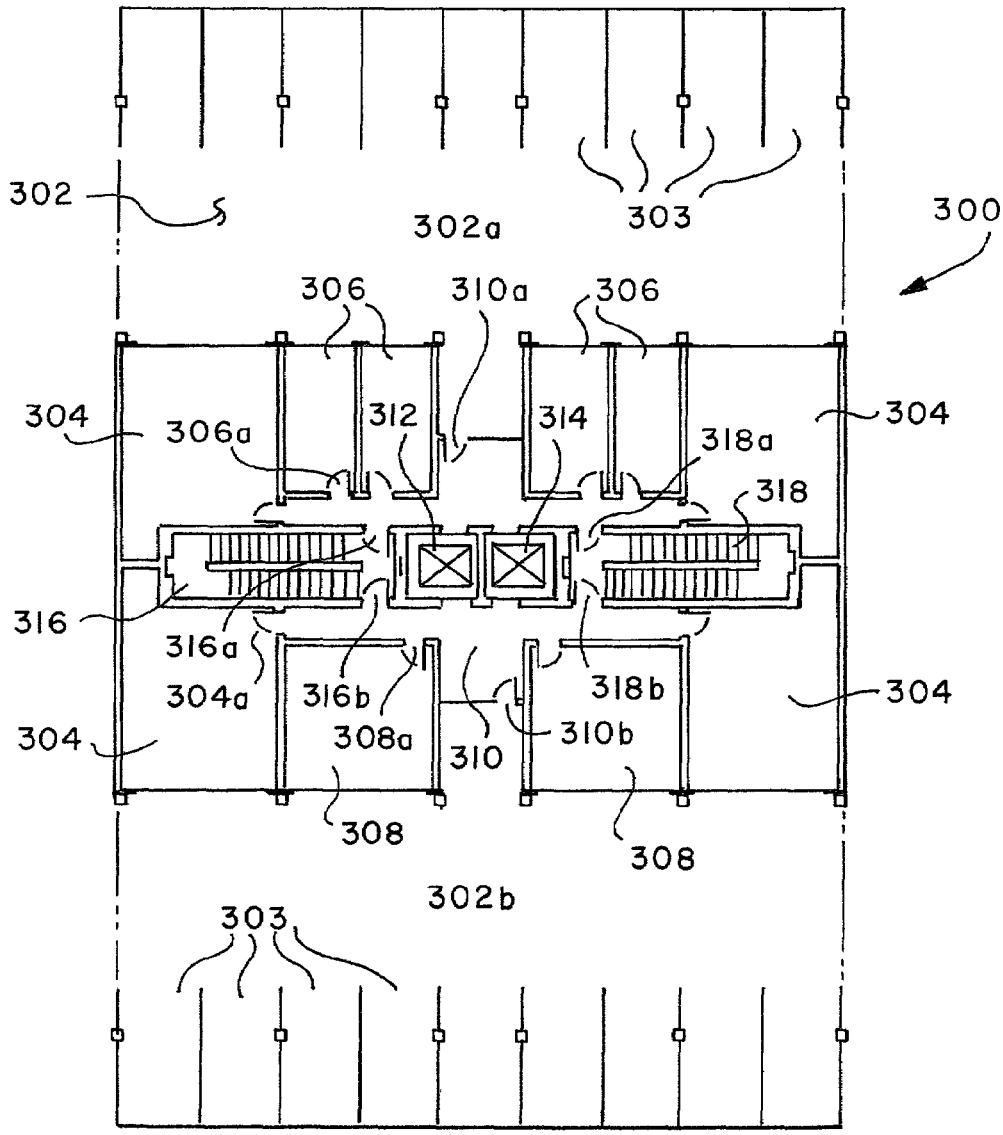
FIG. 9 is a plan view of a garage level of a second alternate embodiment of a multi-story, multiple dwelling unit building complex in accordance with the invention.
Figure 10:
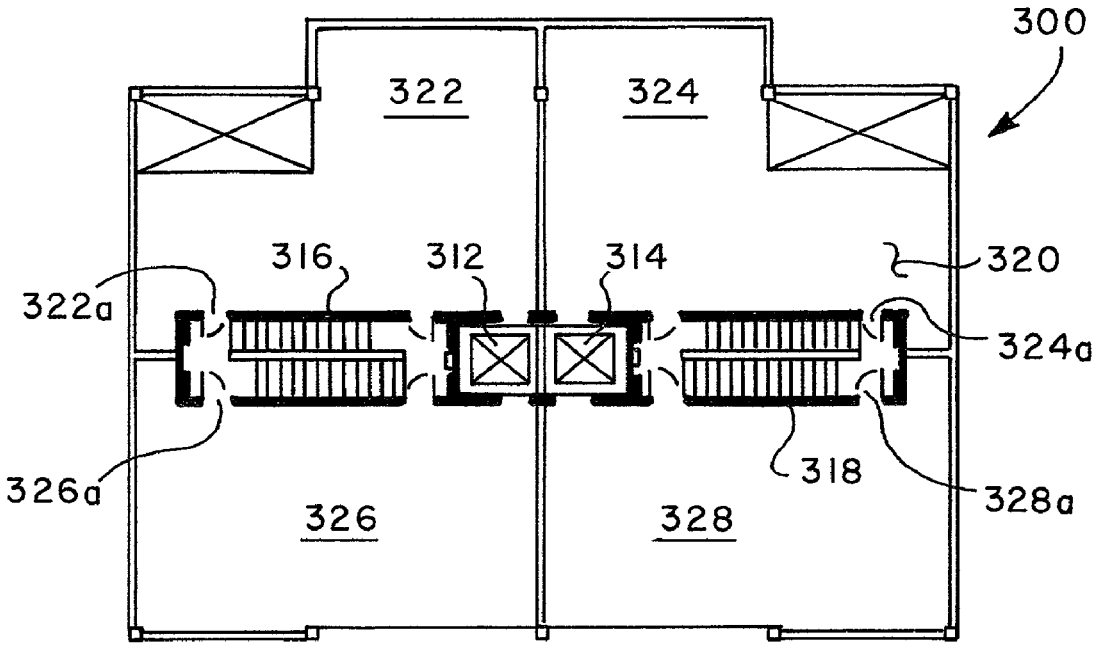
FIG. 10 is a plan view of a dwelling unit level for the complex shown in FIG. 9.

Referring now to FIGS. 9 and 10, a second alternate embodiment of a multi-story, multiple dwelling building complex in accordance with the invention is illustrated and generally designated by the numeral 300. FIG. 9 is a plan view of a typical vehicle parking area for the complex 300 including, by way of example, a street level vehicle parking area 302 having driveways 302*a* and 302*b*, opposed sets of open vehicle parking spaces 303 and sets of back-to-back arranged closeable, private garages 304, 306 and 308. Garages 304 are configured as two-vehicle garages, including additional storage, while garages 306 are single vehicle garages or storage rooms and garages 308 are configured as multiple or two-vehicle garages. Each of the garages opens to a central interior corridor or foyer 310 by way of respective doorways 304*a*, 306*a* and 308*a*. Pedestrian entries to and exits from the foyer 310 are provided at 310*a* and 310*b* for the parking level 302. Multiple parking levels similar to the level 302 may be provided. Foyer 310 provides access to side-by-side elevators 312 and 314. Spaced apart stairways 316 and 318 also open to corridor or foyer 310 at doorways 316*a*, 316*b*, 318*a* and 318*b*, as shown.

Referring to FIG. 10, an exemplary dwelling unit level 320 is illustrated which may be repeated in a multi-story building, such as the building complex 300, and includes dwelling units 322, 324,326 and 328. Elevator 312 provides access to either of dwelling units 322 and 326 while elevator 314 provides access to either of dwelling units 324 and 328. Interior lockable doorways 322*a* and 326*a*, for example, provide access to stairways 316 from dwelling units 322 and 326. In like manner, doorways 324*a* and 328*a* provide access between dwelling units 324 and 328 and stairway 318. A person or persons occupying a dwelling unit on level 320, such as the dwelling unit 322, may have access to a vehicle parking level by way of elevator 312 or stairway 316. When a person exits an elevator at foyer 310 or exits their stairway 316 or 318 at the same foyer they may proceed directly to a garage associated with their dwelling unit in a secure, convenient manner. Accordingly, the complex 300 enjoys substantially all of the advantages of the complexes 20 and 200 previously described. As will be appreciated by those skilled in the art, the complex 300 may have multiple parking garage levels, requiring a ramp, not shown, between levels, as well as multiple dwelling units levels. The parking level 302 and dwelling unit level 320 are exemplary.

Figure 11:
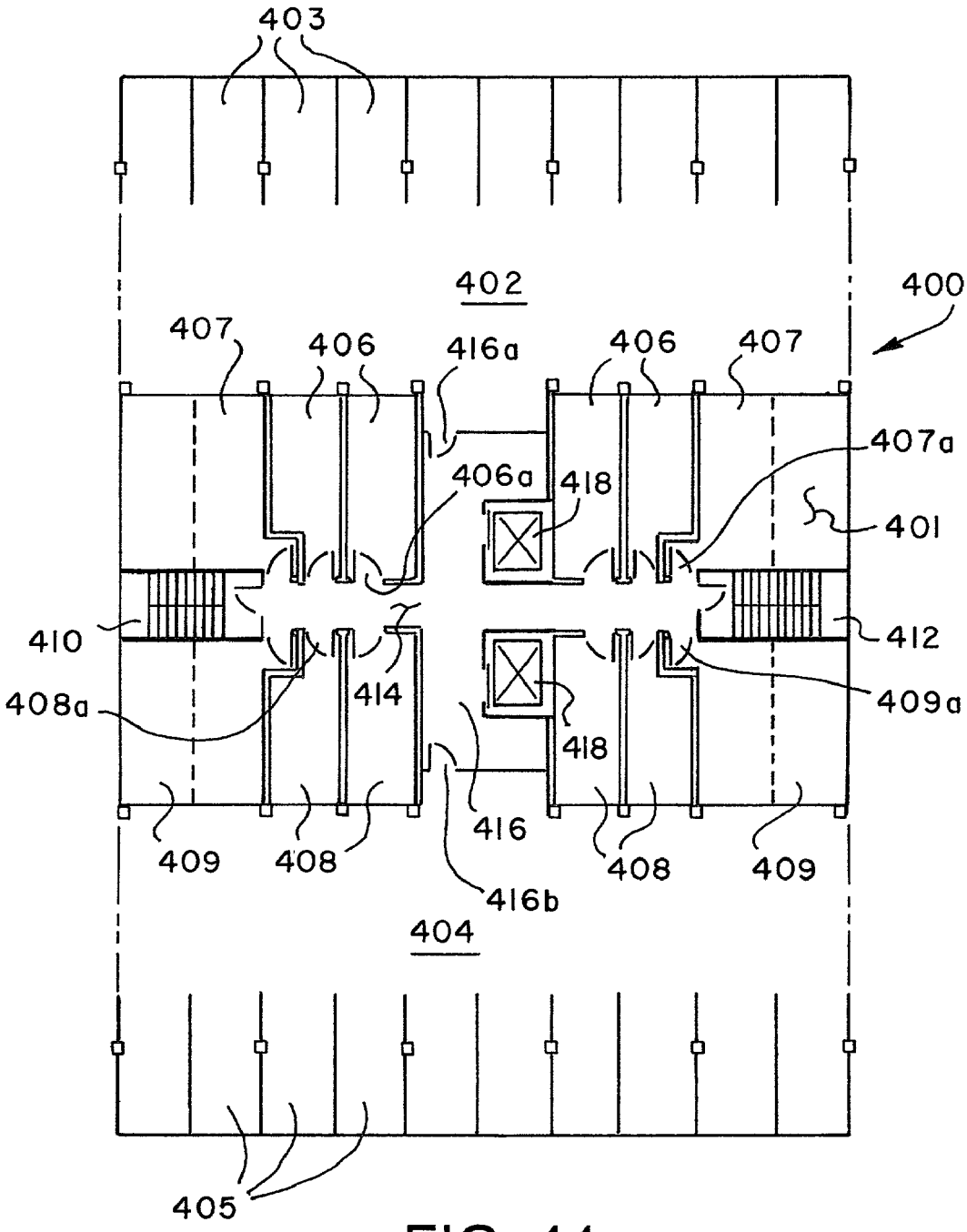
FIG. 11 is a plan view of a garage level of a third alternate embodiment of a multi-story, multiple dwelling unit building complex in accordance with the invention.
Figure 12:
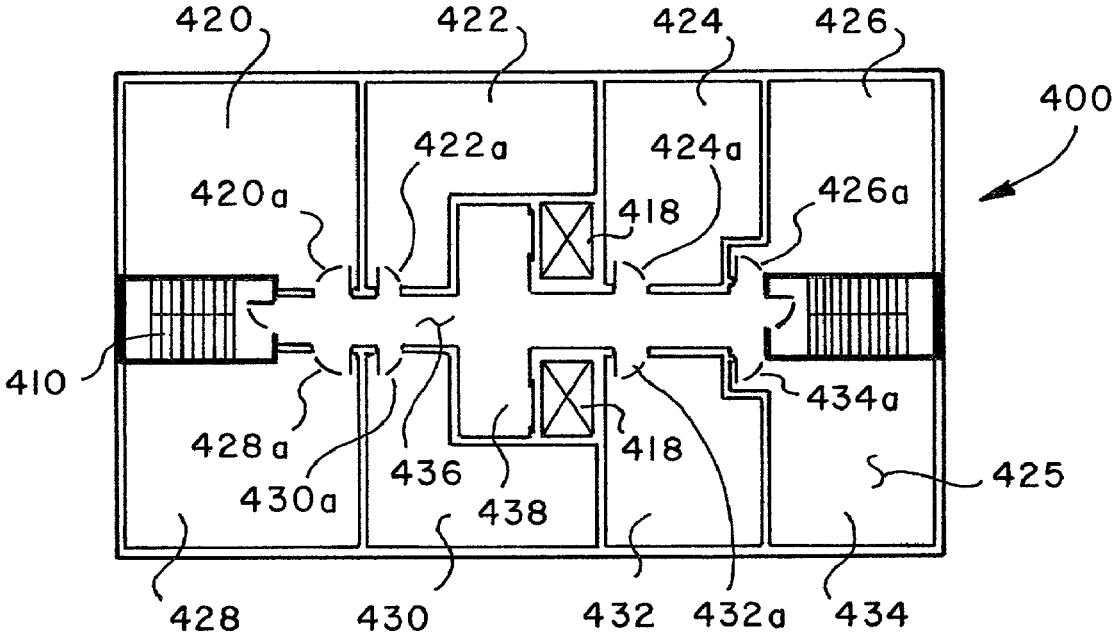
FIG. 12 is a plan view of a dwelling unit level of the building complex shown in FIG. 11.

FIGS. 11 and 12 are plan views of a third alternate embodiment of the present invention comprising a multi-story, multiple dwelling unit building complex, generally designated by the numeral 400. A garage level 401 of the building complex 400 is shown in FIG. 11 and includes vehicle driveway portions 402 and 404 and opposed sets of open vehicle parking spaces 403 and 405. Opposed single vehicle garages 406 and 408 open to the driveways 402 and 404, respectively, and opposed multiple vehicle garages 407 and 409 are also provided as illustrated. Spaced apart stairways 410 and 412 open into a central corridor 414 as do each of the aforementioned garages. Corridor 414 is intersected by a foyer 416 at which elevators 418 are disposed on opposite sides of corridor 414. Foyer 416 also provides access to the driveways 402 and 404 and the vehicle parking spaces 403 and 405 through doorways 416*a* and 416*b*. Garages 406, 407, 408 and 409 open into the corridor 414 by way of respective doorways 406*a*, 407*a*, 408*a* and 409*a*.

Referring now to FIG. 12, a typical dwelling unit level 425 of the building complex is shown wherein dwelling units 420, 422, 424, 426, 428, 430, 432 and 434 may be accessed via a common central corridor 436 which is intersected by a foyer 438 at which elevators 418 provide access between the garage level 401 and the dwelling unit level 425. Stairways 410 and 412 also open to the corridor 436 at opposite ends thereof. Dwelling units 420 through 434 include doorways 420*a* through 434*a* opening into corridor 436. Accordingly, occupants of the dwelling units of the building complex 400 have access to a garage level, such as the garage level 401 by way of a doorway in their respective dwelling unit open to corridor 436 and elevators 418 via the foyer 438. Alternatively, the opposed stairways 410 and 412 are also accessible via the corridor 436 whereby occupants of the respective dwelling units may have access to the garage level 401, which may be a ground level, via the stairways or the elevators. Multiple access routes between dwelling unit levels, such as the level 425, and the garage or ground level 401 are provided by the opposed stairways and multiple elevators.

Figure 13:
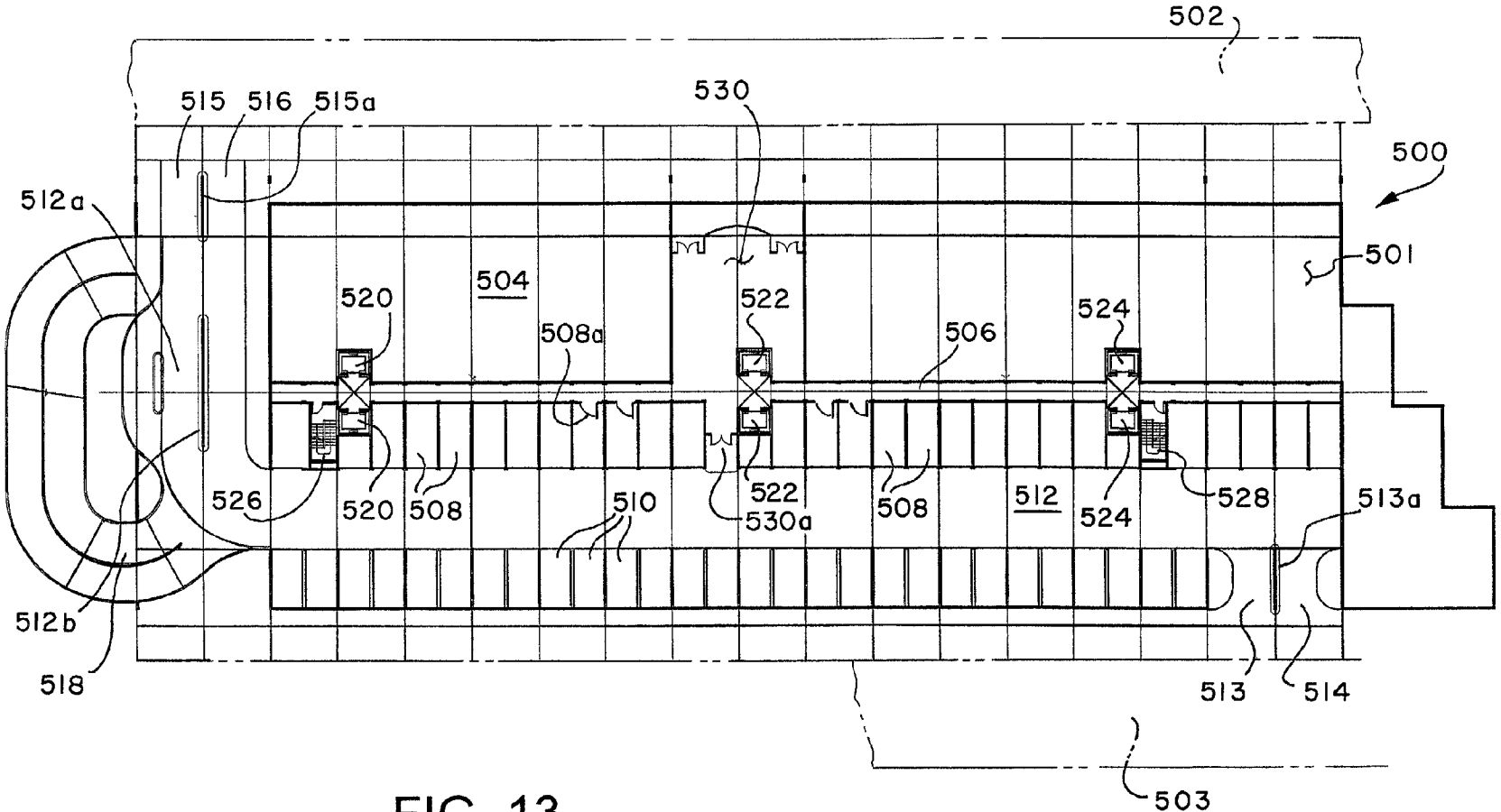
FIG. 13 is a plan view of a ground floor and first garage level of a fourth alternate embodiment of a multi-story, multiple dwelling unit building complex in accordance with the invention.
Figure 14:
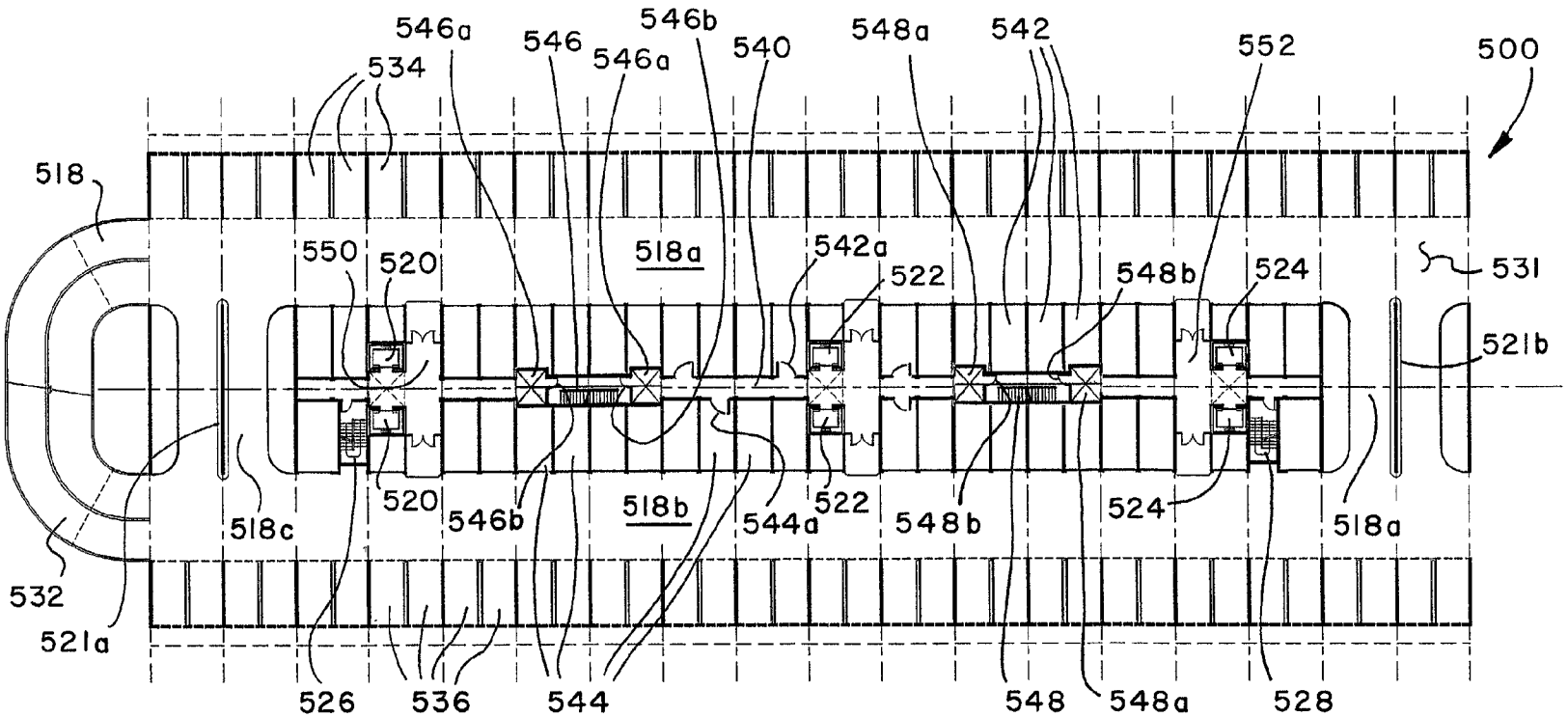
FIG. 14 is a plan view of a second garage level of the building complex shown in FIG. 13.
Figure 15:
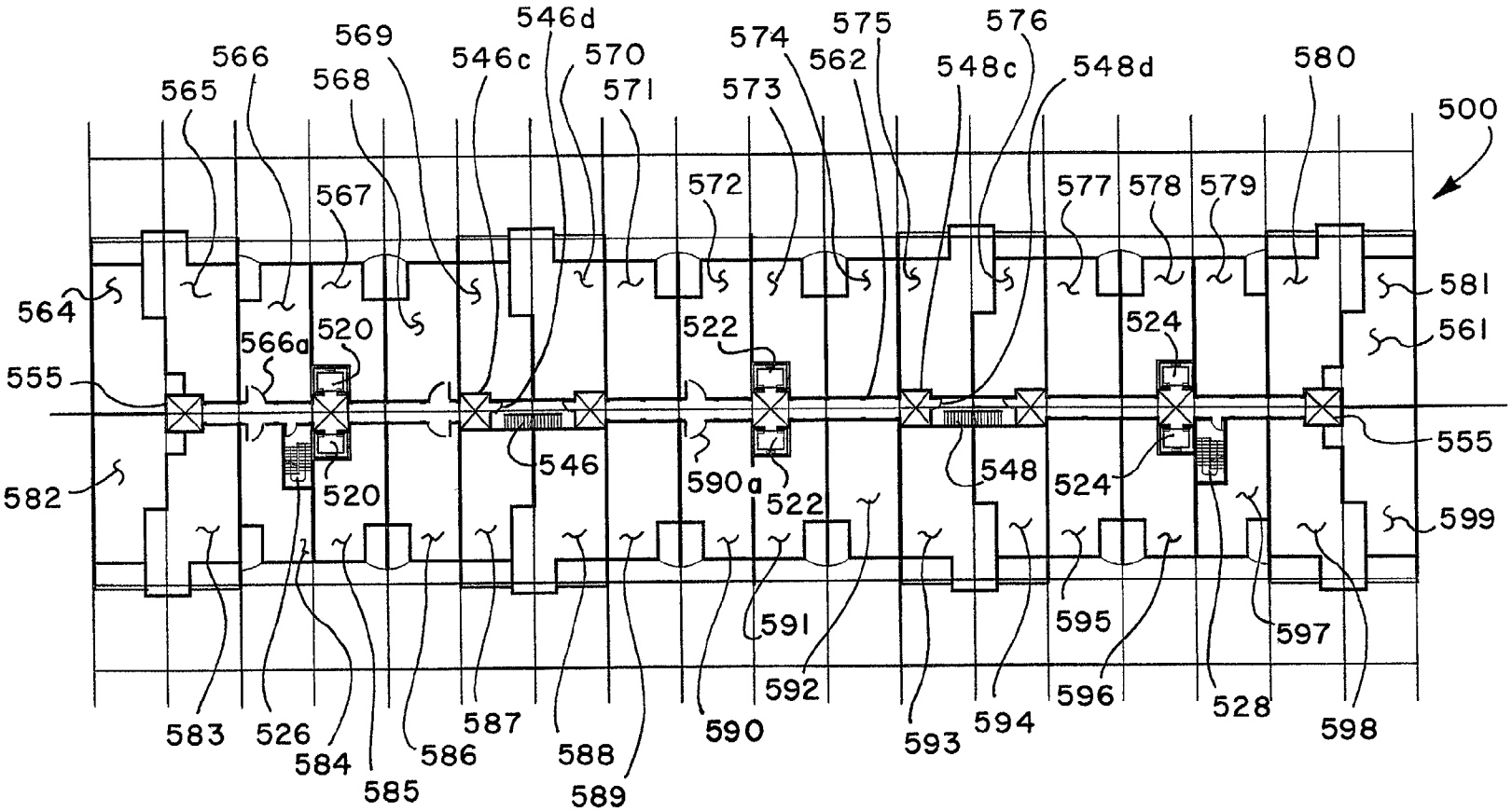
FIG. 15 is a plan view of a dwelling unit level of the building complex shown in FIGS. 13 and 14.

Referring now to FIGS. 13 through 15, and FIG. 13 in particular, floor plans of a multi-story, multiple dwelling unit building complex 500 are illustrated. The multi-story building complex 500 includes a ground level 501 which may front on a roadway 502 on one side of the building complex and a second roadway 503 on the opposite side, by way of example. The ground level 501 of the building complex 500 may include retail merchant spaces 504 bordered on one side by a central longitudinal corridor 506. Plural adjacent private garages 508 are situated side by side on the opposite side of corridor 506 from space 504. Plural vehicle parking spaces or garages 510 are spaced from the vehicle garages 508 by a driveway 512. Driveway 512 may include vehicle exit and entry portals 513, 514 opening to roadway 503 and vehicle entry and exit portals 515 and 516 opening to roadway 502. Driveway section 512*a* is in communication with a spiral, switchback driveway 518 to a second vehicle parking level shown in FIG. 14. Directional vehicle traffic flow dividers 513*a*, 515*a* and 512*b* may be provided as shown in FIG. 13.

Referring further to FIG. 13, the building complex 500 includes spaced apart sets of elevators 520, 522 and 524 and spaced apart stairways 526 and 528. Elevators 520, 522 and 524 open to opposite sides of corridor 506. Stairways 526 and 528 open to corridor 506. Each of garages 508 opens to corridor 506 via doorways 508*a*, shown by way of example only, in the drawing figure. A ground level foyer 530 also opens to corridor 506 and is directly accessible via elevators 522. Foyer 530 is also accessible to driveway 512 and parking spaces 510 through a doorway 530*a*. Persons having access to respective vehicle garages 508 may enter and exit the building complex in motor vehicles via the portals 514, 513, 515 and 516, park their vehicles in their garages 508 and access any one of elevators 520, 522 and 524 via corridor 506.

Referring now to FIG. 14, a second garage level of building complex 500 is illustrated and generally designated by the numeral 531. Garage level 531 is accessible via driveway 518 and is provided with opposed sets of parking spaces 534 and 536 which are accessible via longitudinal driveway portions 518*a* and 518*b*. Driveway portions 518*a* and 518*b* are interconnected by driveway portions 518*c* and 518*d* having suitable traffic flow dividers interposed therein and designated by numerals 521*a* and 521*b*. A third parking level above parking level 531, if provided, would be accessible via a spiral, inclined driveway part 532, as shown in FIG. 14.

The respective sets of elevators 520, 522 and 524 open to opposite sides of an elongated central corridor 540 which is also accessible by the stairways 526 and 528. Longitudinal corridor 540 is interposed opposed sets of private vehicle parking garages 542 and 544, as shown, which have respective doorways 542*a* and 544*a* opening to the corridor 540. As shown in FIG. 14, the corridor 540 may also be intersected by spaced apart stairways 546 and 548 which may provide access to additional garage levels above garage level 531 or to dwelling unit levels above garage level 531, a representative one of which will be described further herein in conjunction with drawing FIG. 15. Stairways 546 and 548 may also extend to garage level or street level 501, although these stairways are not shown in FIG. 13. Stairways 546 and 548 also open into foyers 546*a* and 548*a*, which may include doorways 546*b* and 548*b*.

Corridor 540 is also intersected by foyers 550 and 552 adjacent the elevator sets 520 and 524. Foyers 550 and 552 open to the driveways 518*a* and 518*b* so that persons parking in the parking spaces 534 and 536 may have access to the respective elevators and stairways which open to corridor 540. Placement of the stairways 546 and 548 in corridor 540 tend to reduce the perception of the extreme longitudinal extent of the corridor in relatively large building complexes. Those skilled in the art will recognize that the building complex 500 may have any number of garages and dwelling units arranged generally linearly on each side of a central corridor at each level and for buildings having more than about ten to fourteen dwelling units per level, for example, the placement of the stairways 546 and 548 is advantageous and also may satisfy regulatory requirements for stairway spacings.

Referring now to FIG. 15, a typical dwelling unit level of the building complex 500 is illustrated and generally designated by the numeral 561. The dwelling unit level 561 is vertically spaced above garage level 531 which is vertically spaced above ground level 501. Dwelling unit level 561 is also characterized by an elongated central corridor 562 interposed multiple dwelling units 564 through 581 and 582 through 599, by way of example. Each of the dwelling units 564 through 599 opens into the corridor 562 through suitable doorways, such as doorways 566*a* and 590*a*, by way of example. Elevators 520, 522 and 524 open to corridor 562 as do stairways 526, 528, 546 and 548. Foyers 546*c* and doorways 546*d* are interposed in corridor 562, as shown, to interrupt the perception of the extreme length of the corridor for multiple dwelling unit buildings having a somewhat linear arrangement, as illustrated in FIGS. 13 through 15.

Multiple dwelling unit building complex 500 may be made up of one or more sets of plural dwelling units arranged as a complete complex or arranged in different patterns which repeat the arrangement or set of dwelling units, as needed. By way of example, in FIG. 15, opposed sets of twelve dwelling units are shown wherein a set of dwelling units 564, 565, 566, 567, 568, 569 and dwelling units 582, 583, 584, 585, 586 and 587 may make up a complete building unit. The opposed sets of dwelling units are separated by back to back sets of dwelling units 570, 571, 572, 588, 589, 590 and 573, 574, 575, 591, 592, 593. The building complex 500 may also include spaced apart service elevators 555 opening to the corridor 562 at opposite ends thereof and extending to a garage level such as the garage level 531 or to ground level 501, if desired.

Accordingly, persons occupying dwelling units in the building complex 500 may not have total privacy when moving between their respective dwelling units and their respective garages or parking spaces. However, semiprivate access is provided by the locations of the elevator sets 520, 522 and 524 and the stairways 546 and 548, in particular. Moreover, the design of the building complex 500 is such that, depending on the dimensions of the building site, the floor plan of one stairway, such as the stairway 526, a set of elevators, such as the elevators 520 and a set of as many as twelve dwelling units may be repeated as necessary to provide economy of construction and provide for maximizing the usable space on the site.

Figure 16:
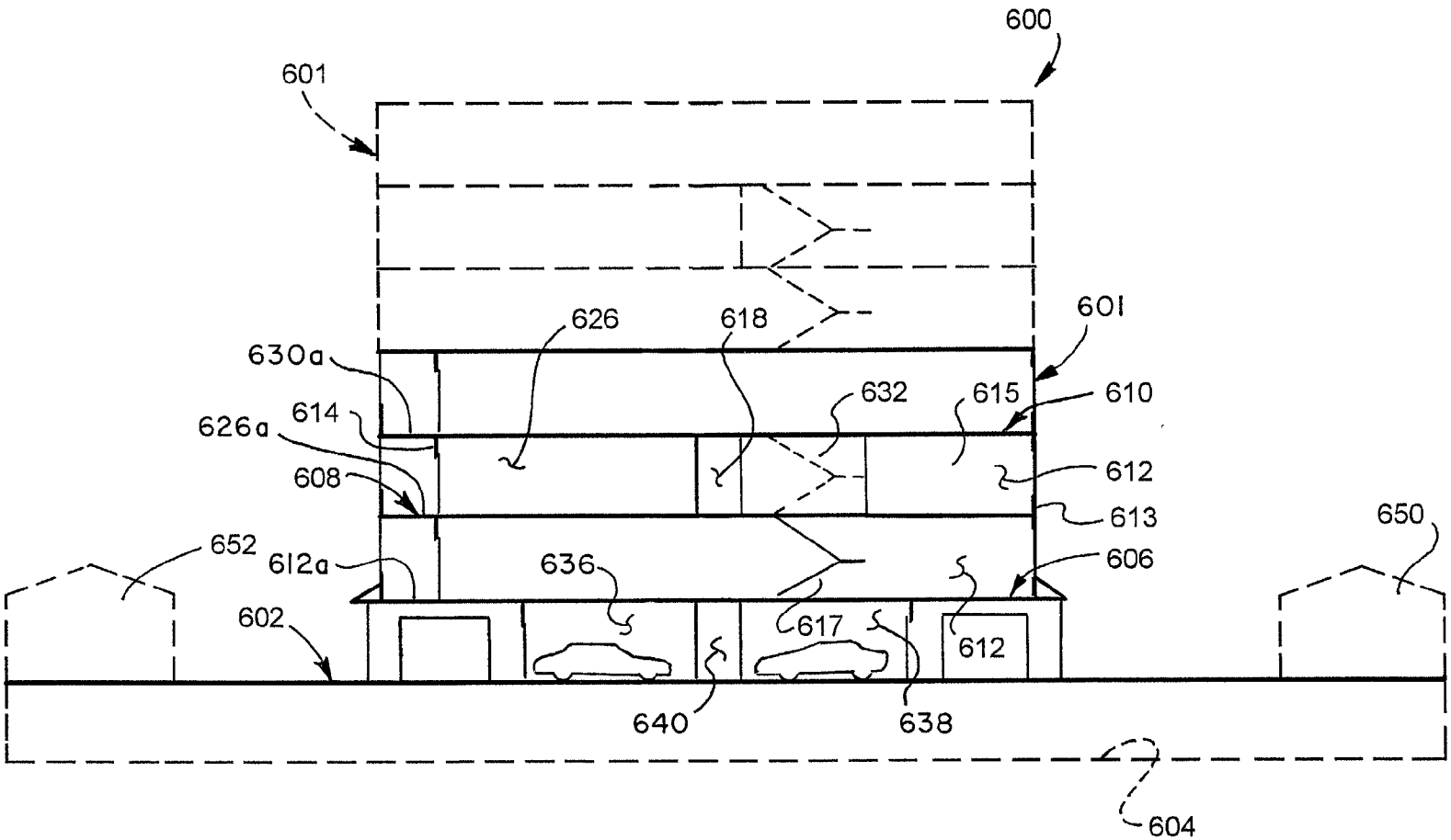
FIG. 16 is a somewhat schematic vertical section view of a fifth alternate embodiment of a multi-story, multi dwelling unit building complex in accordance with the invention.
Figure 18:
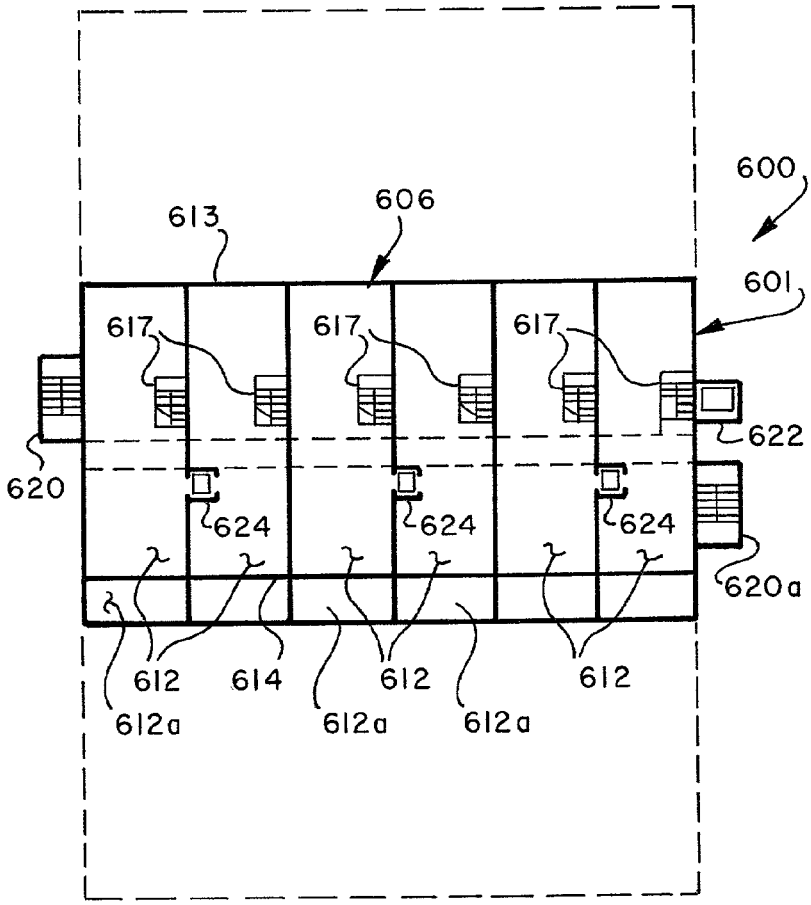
FIG. 18 is a plan view of the first dwelling unit level for the building complex shown in FIG. 16.

Referring now to FIGS. 16 and 18, there is illustrated another multi-story, multiple dwelling unit building complex in accordance with an embodiment of the present invention and generally designated by the numeral 600. The building complex 600 may, for example, be constructed in multiple three story modules 601 or three dwelling unit "levels" of multiple dwelling units in accordance with the construction methods described hereinbefore. By way of example, the building complex 600 also includes a motor vehicle storage level 602 comprising garages and vehicle parking spaces which may be at ground level. If more than one three story module 601 is constructed, additional vehicle storage or parking levels may be added above or below ground. A below grade parking deck or level 604 is indicated by the dashed lines in FIG. 16. The building complex 600 includes a first dwelling unit level 606 disposed above the parking level 602, a second dwelling unit level 608 disposed above the dwelling unit level 606 and a third dwelling unit level 610 disposed above the dwelling unit level 608 as indicated in FIG. 16. FIG. 16 also illustrates how a second module 601 of three additional dwelling unit levels may be added to the building complex 600. The second module 601 may be a duplicate of the module which forms the dwelling unit levels 606, 608 and 610.

Figure 19:
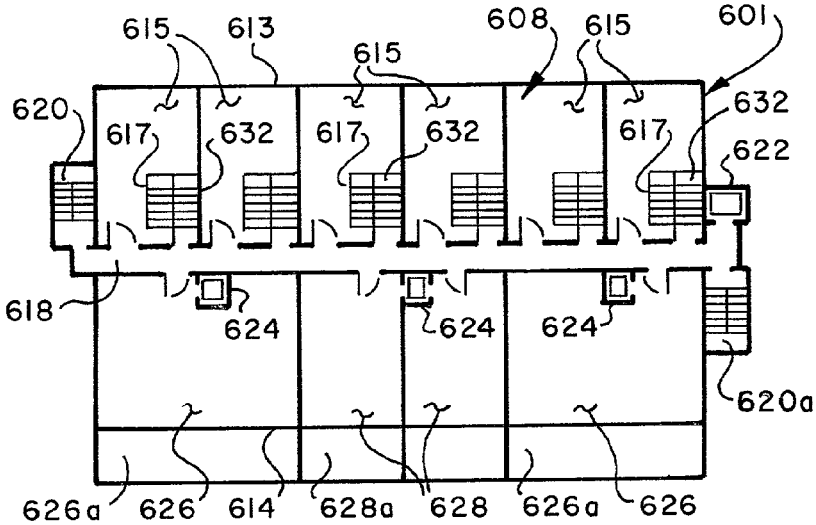
FIG. 19 is a plan view of the second dwelling unit level for the building complex shown in FIG. 16.

As shown in FIGS. 16 and 18, dwelling unit level 606 may be provided with multiple side-by-side townhouse style dwelling units 612 which may extend across or through all of dwelling unit level 606 between opposed sidewalls 613 and 614. Each of the dwelling units 612 also includes a portion of the dwelling unit level 608 including living space 615, as indicated in FIGS. 16 and 19. Private dwelling unit stairways 617 interconnect the living space of each dwelling unit 612 on level 606 with the living space 615 of each dwelling unit 612 located on level 608. Building complex 600 may be arranged to provide an aesthetically pleasing view from the side which is delimited by wall 614 whereby balconies 612*a* may be provided, one shown in FIG. 16.

As shown in FIG. 19, dwelling unit level 608 includes a longitudinal central corridor 618 accessible to all dwelling units 612 by way of doorways at living spaces 615 on dwelling unit level 608. Corridor 618 is accessible by a stairway 620, FIG. 19, which may extend to the ground or garage level 602. Actually, stairways are provided at opposite ends of the building complex 600 as indicated by a second stairway 620*a* in FIG. 19. Additionally, a freight or service elevator 622 may be provided to allow deliveries and pickup by service personnel, as shown in FIG. 19. Freight elevator 622 opens to corridor 618 as indicated in FIG. 19.

Figure 17:
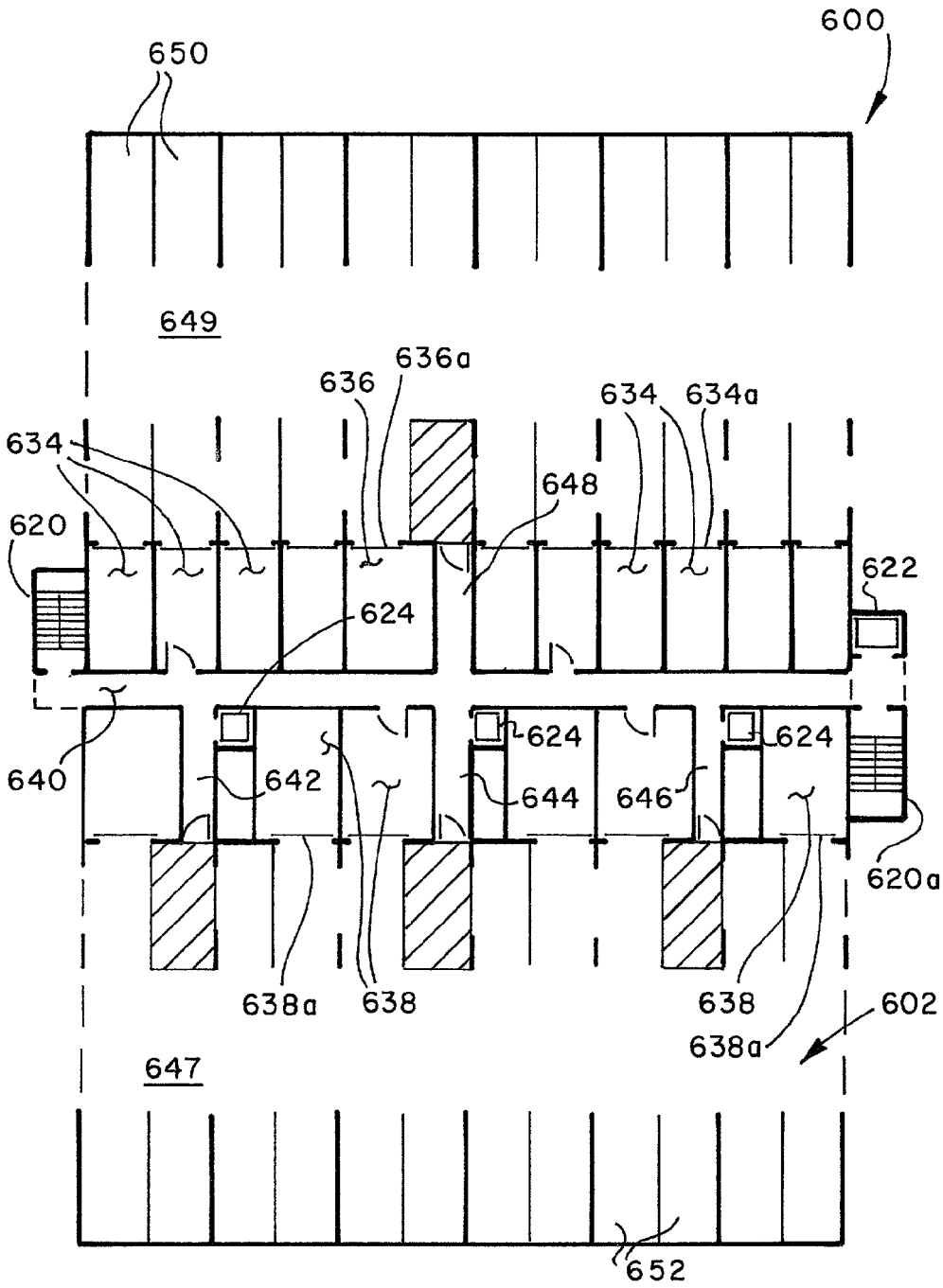
FIG. 17 is a plan view of the garage and ground level for the building complex shown in FIG. 16.

Referring again to FIG. 18, private or semiprivate elevators 624 extend from garage level 602, as shown in FIG. 17, through to the upper level 610 of building complex 600. Accordingly, an elevator 624 may open to each dwelling unit 612 on level 606 as well as to additional dwelling units on levels 608 and 610 as will be explained further herein. Accordingly, entry to and exit from each dwelling unit 612 may be obtained via elevators 624 with respect to the garage or ground level 602 and pedestrian movement between each dwelling unit 612 and ground level 602 may also be obtained by way of corridor 618 and stairways 620 and 620*a* and/or elevator 622.

As shown in FIGS. 16 and 19, dwelling unit level 608 may include additional single level dwelling units 626 and 628 which may be of selectively variable size and are each accessible via an elevator 624. An elevator 624 opening to a dwelling unit 626 on level 608 opens only to that dwelling unit while another elevator 624 opens to two dwelling units 628, as shown. Moreover, each of the dwelling units 626 and 628 may have a doorway to the corridor 618, as shown. Accordingly, each dwelling unit 622 or 628 on level 608 also has an alternate pathway between the dwelling unit and the ground or garage level 602. Each dwelling unit on level 608 may include a balcony, as indicated by numeral 626*a* in FIG. 16, by way of example.

Figure 20:
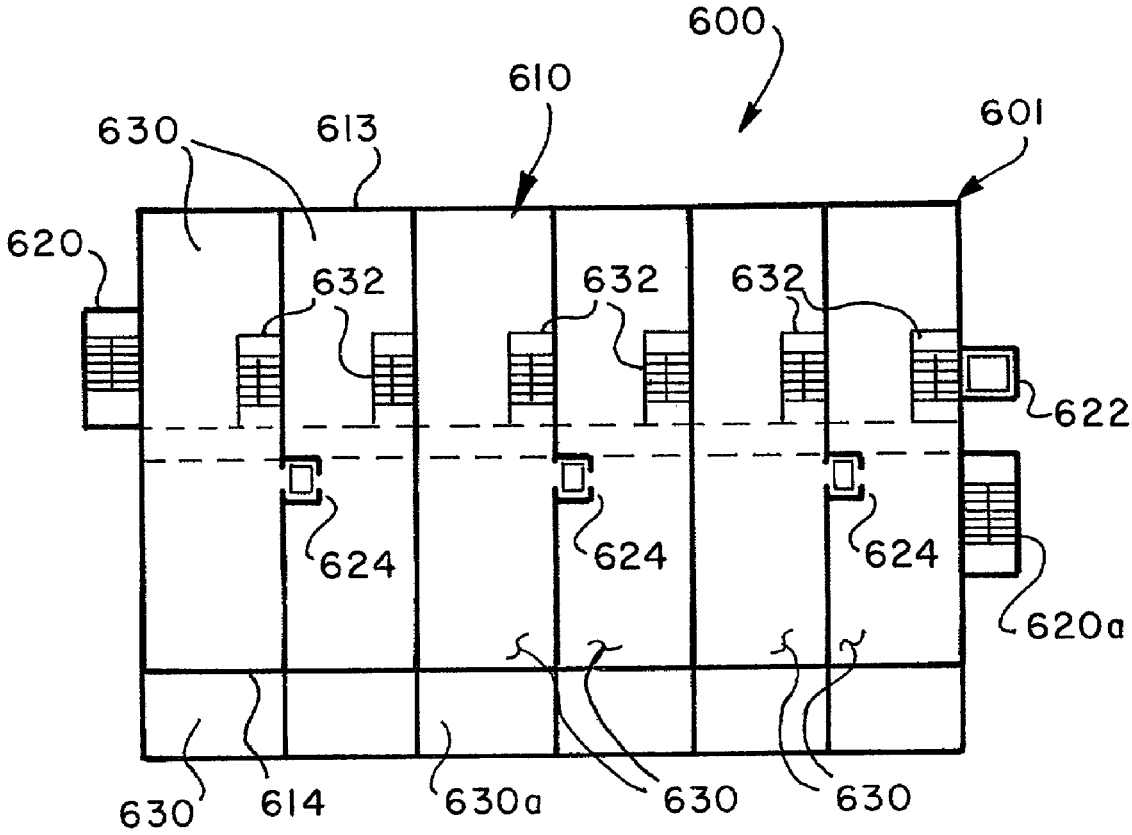
FIG. 20 is a plan view of the third dwelling unit level for the building complex shown in FIG. 16.

Still further, referring to FIG. 20, dwelling unit level 610 includes multiple side-by-side dwelling units 630 which occupy all of the space at dwelling unit level 610 between opposed sidewalls 613 and 614, as indicated in drawing FIG. 20. Still further, each of the dwelling units 630 is accessible by way of an elevator 624 and by way of stairways 632, respectively, which extend between each dwelling unit 630 and the corridor 618 on dwelling unit level 608. If a dwelling unit module 601 is added to the building complex 600, an additional corridor 618 would be provided at the intermediate level of module 601 and be placed in pedestrian transit communication with elevator 622 and stairways 620 and 620*a*. Still further, each module 601 may be modified to provide a lower level living space on level 608 for each dwelling unit 630 in place of one or more of dwelling units 626 and 628.

Referring now to FIG. 17, garage and also ground level 602 is provided with plural back-to-back arranged private motor vehicle garages 634, 636 and 638 which are arranged on opposite sides of an optional longitudinal central corridor 640. Corridor 640 opens to spaced apart lateral corridors 642, 644, 646 and 648. Elevators 624 open to each of the corridors 642, 644 and 646 which have exit pathways to driveways 647 by way of corridors 642, 644 and 646, and also to an opposite driveway 649 by way of corridor 648. Accordingly, if optional corridor 640 is not provided persons using any of the elevators 624 may have access to their garage by way of respective corridors 642, 644 and 646, 648, as will be apparent from viewing FIG. 17.

Still further, garage level 602 for the building complex 600 includes additional parking spaces, covered parking spaces or garages 650 and 652, as indicated in FIGS. 16 and 17. Accordingly, the building complex 600 enjoys all of the benefits of the present invention including private or semi-private access between a garage or parking space at a garage or parking level, such as level 602, and a dwelling unit on any one of the dwelling unit levels 606, 608 and 610. Each of the private garages 634, 636 and 638 is provided with a suitable vehicle door, indicated by numerals 634*a*, 636*a* and 638*a* in FIG. 17, and if optional corridor 640 is provided, each of the garages 634, 636 and 638 may have access to the corridor by way of a pedestrian doorway opening directly from each garage to the corridor 640.

Figure 21:
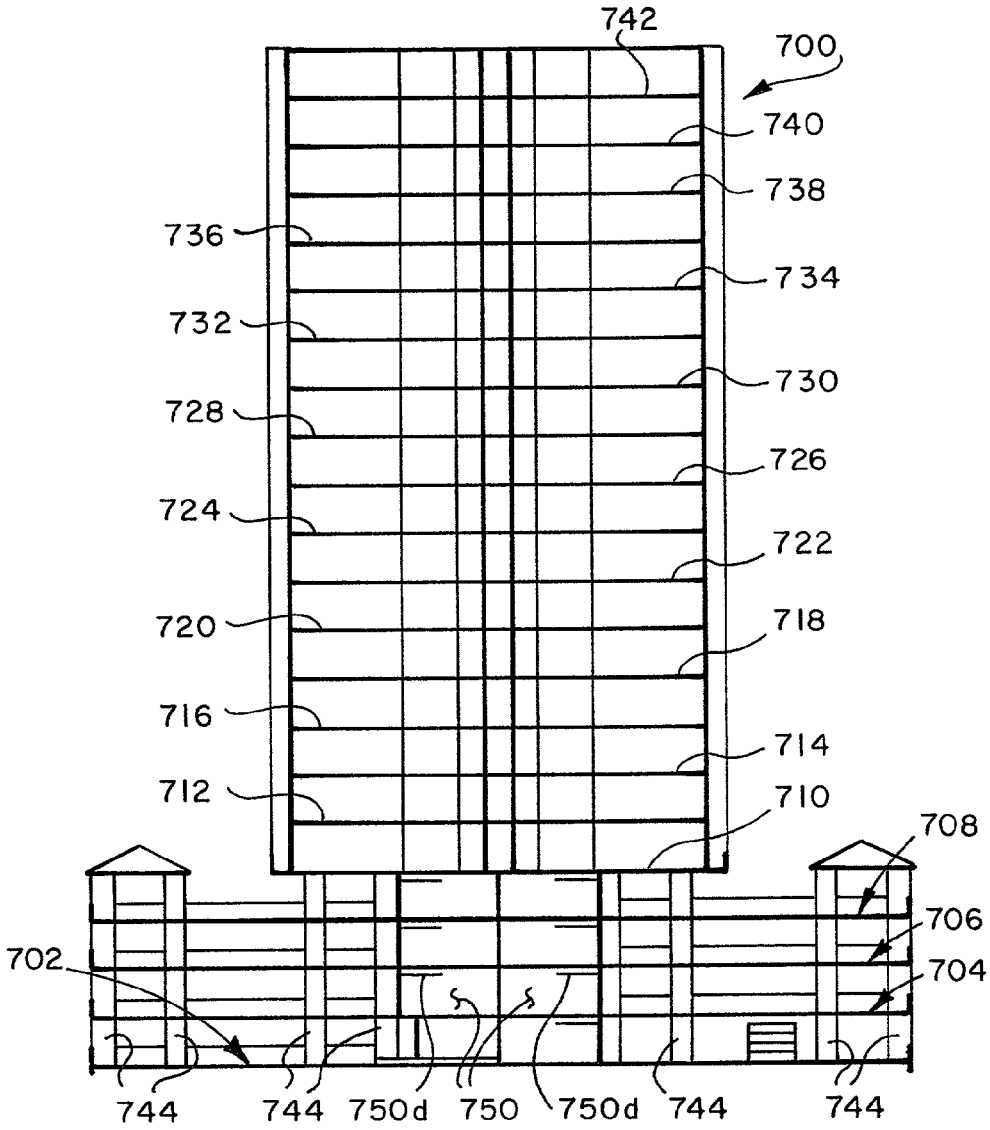
FIG. 21 is a somewhat schematic vertical section view of a sixth alternate embodiment of a multi-story multiple dwelling unit building complex in accordance with the invention.
Figure 22:
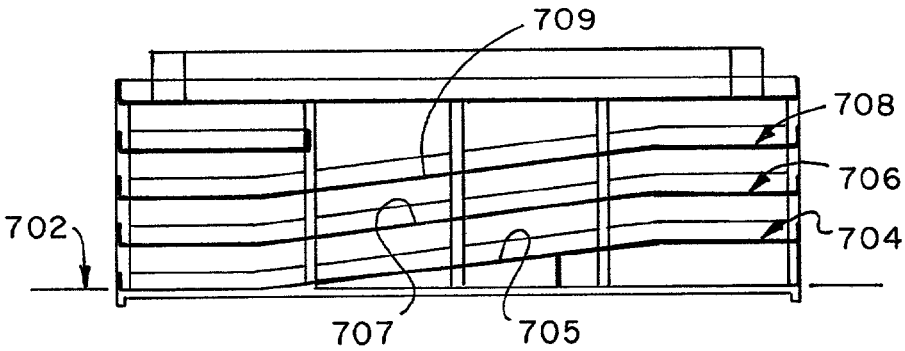
FIG. 22 is an elevation showing the ramps between the multiple parking levels for the building complex shown in FIG. 21.

Referring now to FIGS. 21 through 25, still another embodiment of the invention is illustrated in the form of a multi-story, multiple dwelling unit building complex generally designated by the numeral 700. As shown in FIG. 21, the building complex 700 includes multiple vertically spaced vehicle parking levels, including a ground level 702 and three levels or decks thereabove and designated by the numerals 704, 706 and 708. As shown in FIG. 22, access to parking levels or decks 704, 706 and 708 may be accomplished by respective motor vehicle ramps 705, 707 and 709 whereby vehicular traffic may move between ground or street level 702 and the other three vehicle parking levels indicated.

As further shown in FIG. 21, the multi-story building complex 700 includes apartment or dwelling unit levels 710 through 742, there being indicated seventeen levels or floors in all, and by way of example only. The building complex 700 may be constructed using the techniques discussed hereinbefore and at least the parking levels or decks may be further reinforced by spaced apart column member 744, as indicated in the drawing figures.

Figure 23:
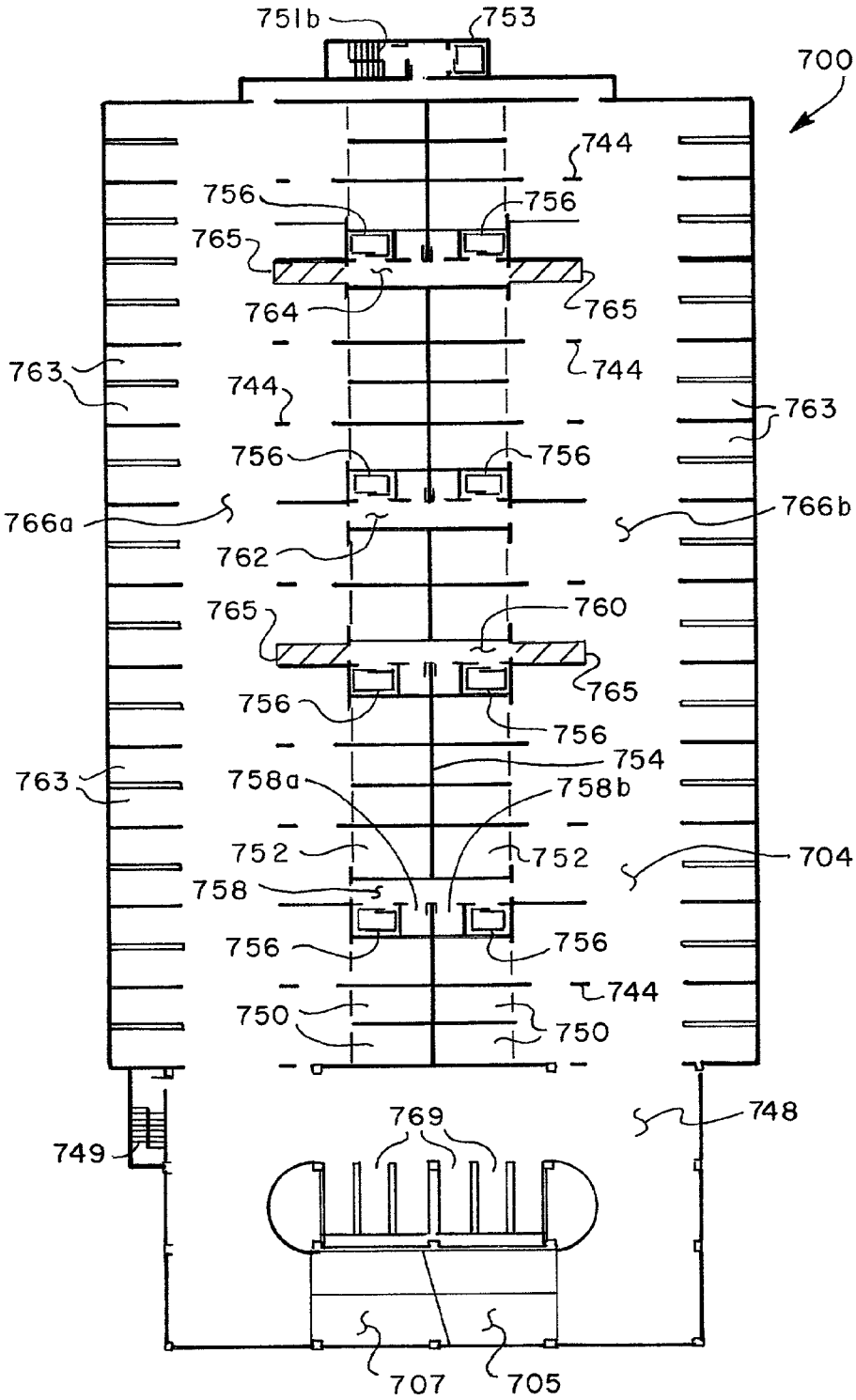
FIG. 23 is a plan view of a typical one of the garage levels for the building complex shown in FIG. 21.

Referring to FIG. 23, by way of example, the vehicle parking level 704 is illustrated showing the two way vehicle ramp 705 between level 704 and ground level 702 as well as a portion of two way ramp 707 which extends between level 704 and 706. Parking level 704 includes a deck 748 providing a driveway for vehicles to traverse between parking level 704 and 706 as well as between parking level 704 and ground level 702. A stairway 749 also extends between deck 748 and ground level 702. As further shown in FIG. 23, parking level 704 includes a substantial number of back-to-back arranged vehicle garages 750 and 752 which are separated by a common wall 754. Spaced apart elevators 756 provide access between the parking level 704 and selected respective ones of the dwelling unit levels 710 through 742 by way of respective transverse corridors or foyers 758, 760, 762 and 764. Maintenance or utility rooms 758*a* and 758*b*, for example, may be located adjacent the respective elevator structures as shown. Additional parking spaces 763 are provided at parking level 704 across from the respective garages, and parking level 704 includes sufficient dimensional characteristics to allow for driveway portions 766*a* and 766*b* between all garages and all parking spaces and the deck 748. Diagonal striped areas 765 in FIG. 23 indicate "no parking" surfaces, so as to provide pedestrian access between all garages and parking spaces and corridors 758, 760, 762 and 764, respectively. Additional visitor parking spaces and/or garages 769 are provided on deck 748 adjacent the ramps 705, 707, as shown.

Accordingly, vehicle parking level 704 has a configuration slightly different from certain ones of the previously described embodiments in that a pedestrian pathway between a particular garage 750 or 752 and an elevator 756 leading to a particular dwelling unit does not include a longitudinal central corridor. A second stairway 751 and a service elevator 753 are shown in FIG. 23 extending to parking level 704. Stairway 751 also extends to ground level 702 and may extend to each of the apartment or dwelling unit levels 710 through 742, as may the service elevator 753.

Figure 24:
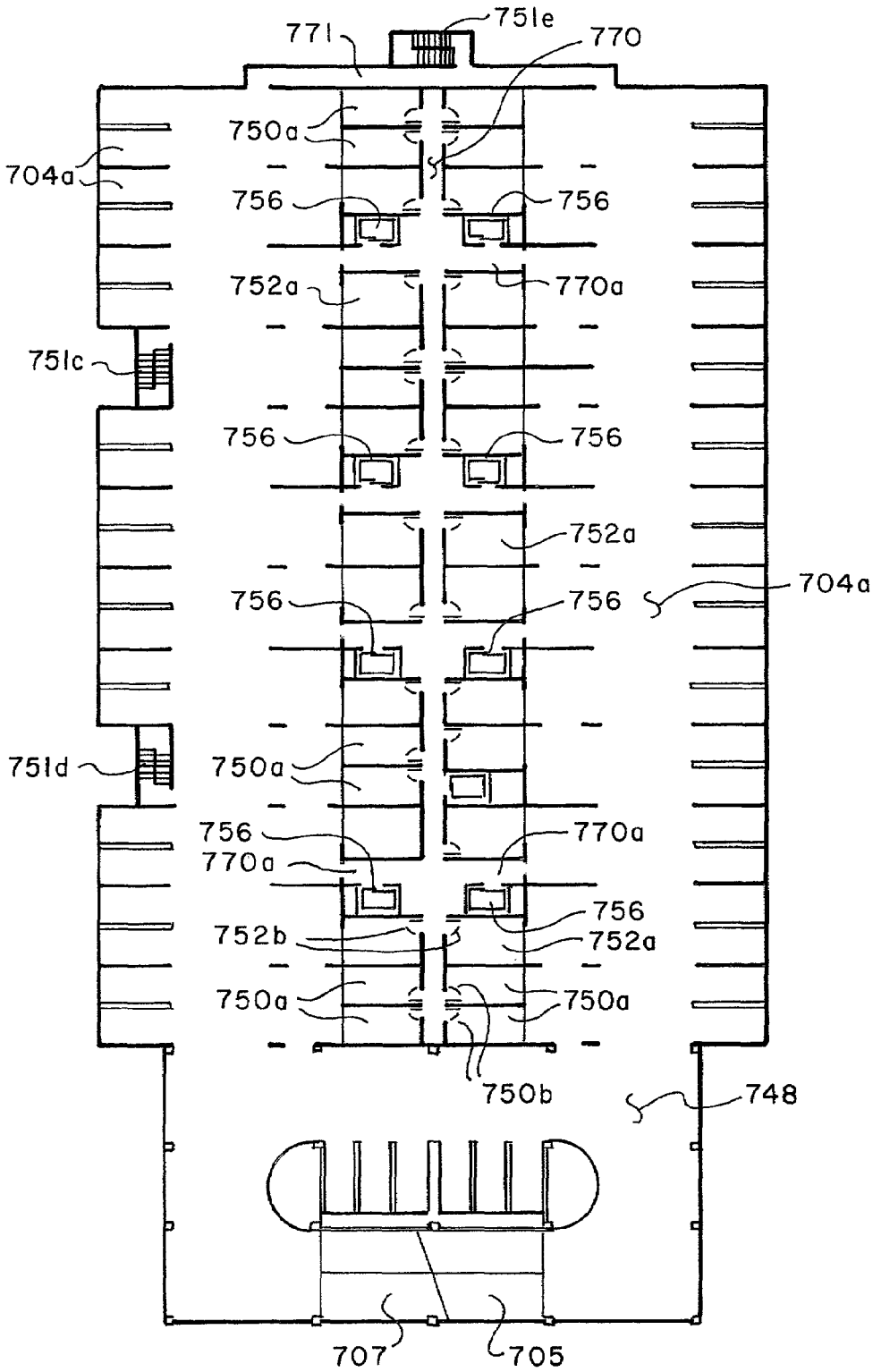
FIG. 24 is a plan view of an alternate embodiment of a parking level for the building complex shown in FIG. 21.

Referring now to FIG. 24, any one of the parking levels 702, 704, 706 and 708 may be modified, as shown in the plan view of FIG. 24, to include a central longitudinal corridor 770 extending the length of such a modified parking level and which parking level is designated 704*a*. In the arrangement of FIG. 24, each of modified garages 750*a* and 752*a* are provided with pedestrian doorways 750*b* and 752*b*, as shown by way of example, to provide access between the private vehicle garages and the central corridor 770. Elevators 756 open directly to transverse or lateral corridors 770*a*, respectively, which have access to corridor 770 via respective doorways, as shown in FIG. 24. In the arrangement of FIG. 24, access between each vehicle garage and respective elevators 756 is similar to the embodiment of FIGS. 1 through 6. Stairway 749 is replaced by stairways 751*c* and 751*d* and stairway 751*b* is replaced by stairway 751*e* at one end of parking level 704*a*. Additionally, a freight or service elevator 753*a* is relocated to the position shown in FIG. 24 and opens to corridor 770, as shown. Access between stairway 751*e* and parking level 704*a* is by way of a corridor 771, as shown in FIG. 24. In other respects, the vehicle parking level 704*a* is similar to parking level 704.

Figure 25:
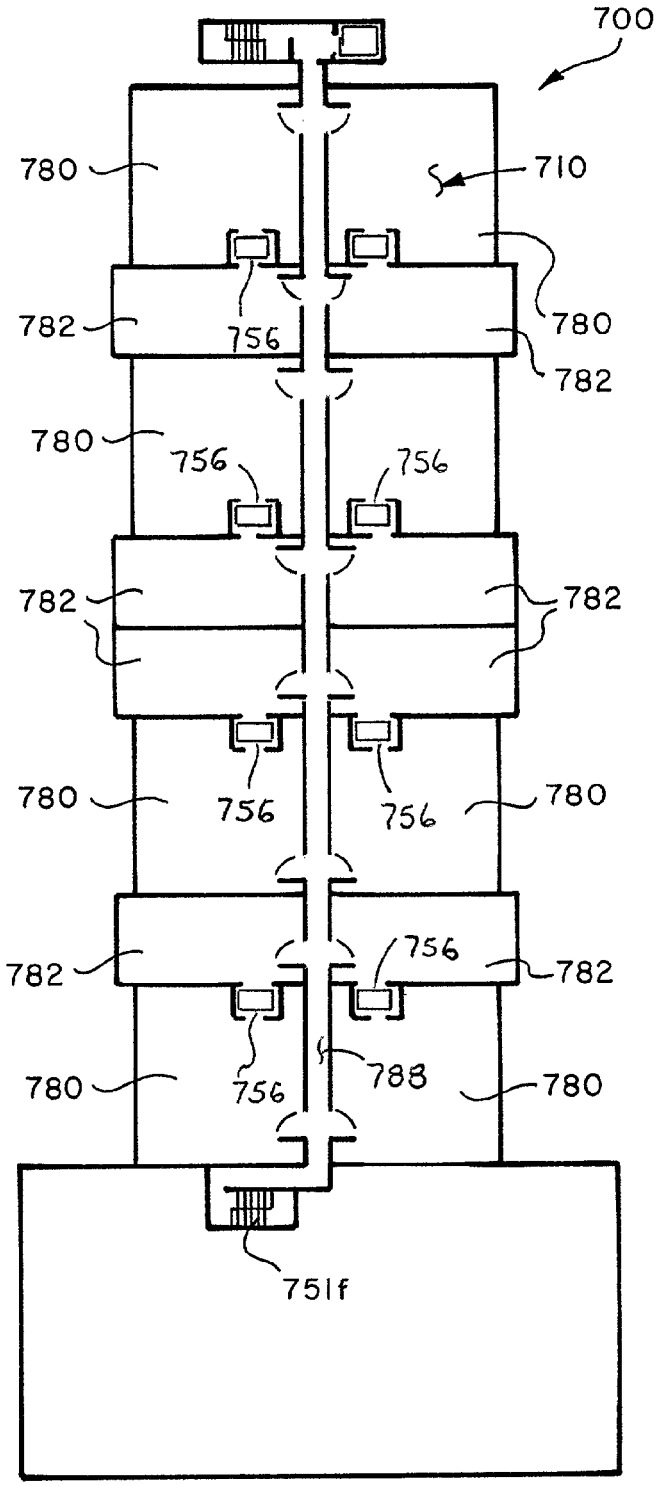
FIG. 25 is a plan view of a typical one of the dwelling unit levels for the building complex shown in FIGS. 21 through 24.

Referring now to FIG. 25, a typical dwelling unit or apartment level for building complex 700 is illustrated and indicated by numeral 710. Dwelling unit level 710 is provided with opposed dwelling units 780 and 782 which are arranged in a somewhat repeating pattern, as indicated, and are each serviced by an elevator 756, also as indicated in FIG. 25. Still further, a stairway 751*f* may be provided at one end of a central service corridor 788 extending longitudinally of the dwelling unit level 710 between stairway 751*b* and 751*f*. Each of dwelling units 780 and 782 also includes at least one doorway opening to service corridor 788 to provide access thereto and to provide an alternate exit path between each dwelling unit level and stairways 751*b* and 751*f*. Accordingly, the multi-story building complex 700 enjoys substantially all of the advantages of the other embodiments described in detail hereinbefore but may eliminate a central corridor at any one of the parking levels. Each of the garages 750 and 752, for example, as well as the garages 750*a* and 752*a* are provided with vehicle closures, such as upward acting doors 750*d*, see FIG. 21, for example.

Figure 26:
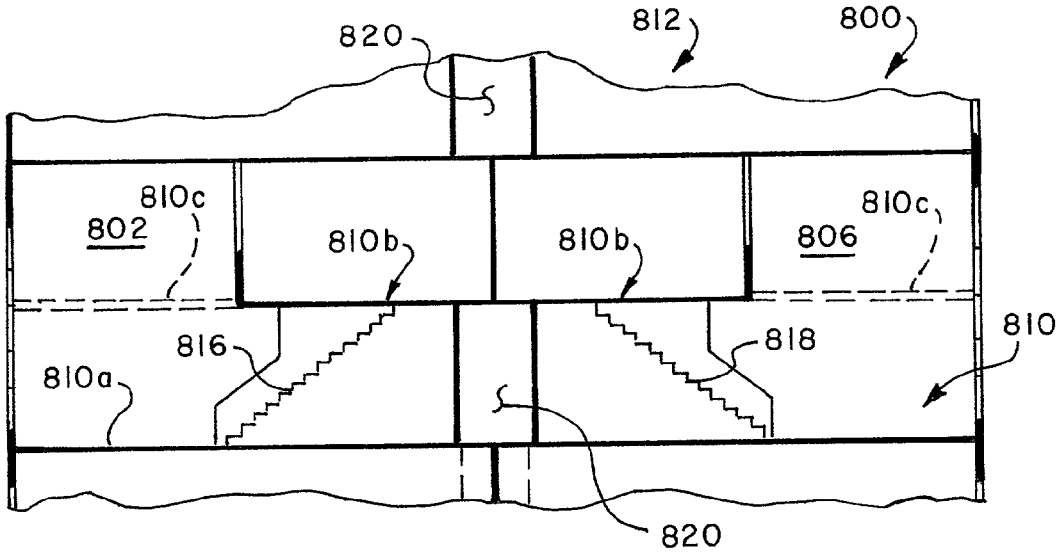
FIG. 26 is a section elevation of a seventh alternate embodiment of the present invention taken from line 26—26 of FIG. 27.
Figure 27:
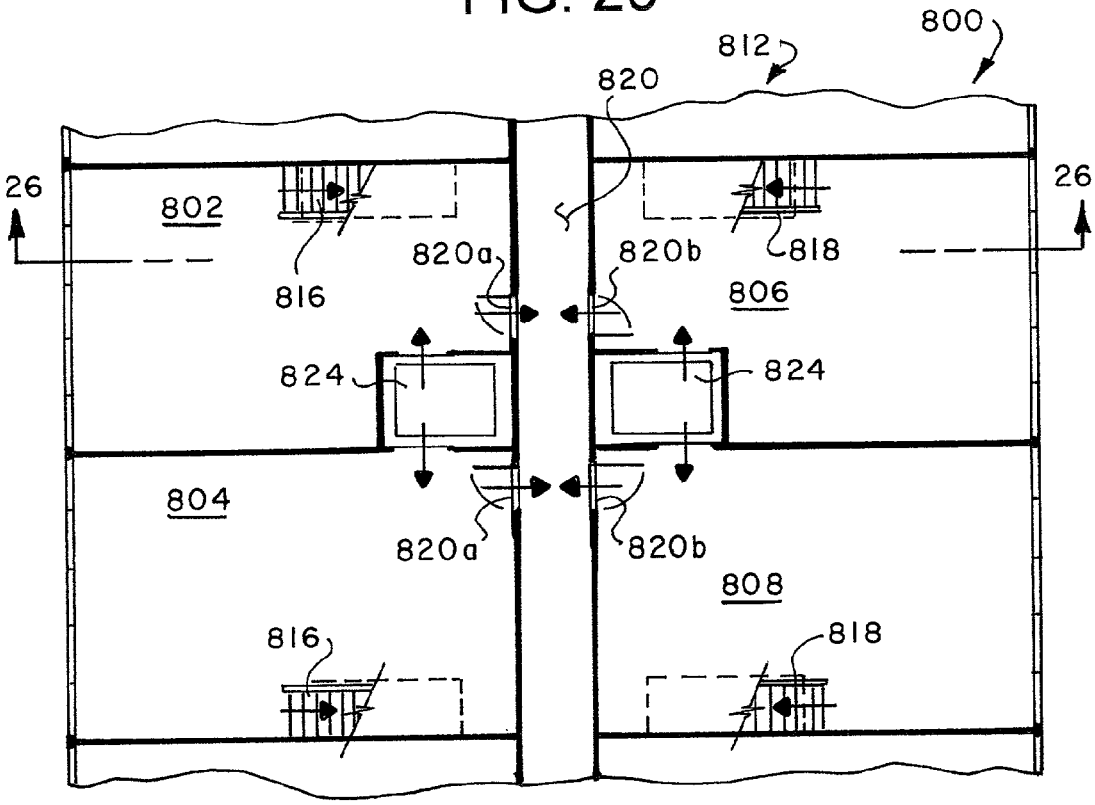
FIG. 27 is a plan view of the seventh alternate embodiment.

Referring now to FIGS. 26 and 27, a seventh alternate embodiment of a multi-story multiple dwelling unit building complex in accordance with the invention is illustrated and generally designated by the numeral 800. The multi-story multiple dwelling unit building complex 800 is characterized by adjacent back to back dwelling units 802, 804, 806 and 808 arranged as shown on a dwelling unit level 810, for example, and comprising a dwelling unit module 812. Dwelling unit modules 812 may be formed in repeated vertically stacked modules as required and may be repeated on each dwelling unit level in a multi-story complex. As shown in FIG. 26, the dwelling units 802, 804, 806 and 808 (units 802 and 806 are shown in FIG. 26) may be two story units having a first level or story 810*a* and a second level 810*b*, respectively. Each level or story 810*b* may be a full story as indicated by the dashed lines or a so-called half story or half level as indicated by the solid lines of FIG. 26. Respective stairways 816 and 818, as shown in FIGS. 26, and 27 may be used to interconnect the two levels of a particular dwelling unit.

As further shown in FIGS. 26 and 27, each dwelling unit level 810 is provided with a central corridor 820 which may be accessed through respective doorways 820*a* and 820*b* to provide access to each dwelling unit of a module 812. Still further, elevators 824 serve a pair of dwelling units, respectively. For example, as shown, an elevator 824 opens into a dwelling unit 802 and dwelling unit 804 while another elevator 824 opens into a dwelling unit 806 and a dwelling unit 808. The dwelling unit modules 812 may be disposed above a garage level or levels like that shown in FIG. 17 wherein each garage level would be modified to accommodate the additional set of elevators on the opposite side of a central corridor, if such were provided. Accordingly, the dwelling unit complex 800 enjoys substantially all of the advantages described hereinbefore for the other embodiments of the present invention.

The construction of the building complexes 20, 200, 300, 400, 500, 600, 700 and 800 may be carried out using architectural engineering practices known to those skilled in the art and with use of conventional construction materials and components. The construction and use of the building complexes 20, 200, 300, 400, 500, 600, 700 and 800 are believed to be understandable to those of ordinary skill in the art from the foregoing description read in conjunction with the drawings.

Although preferred embodiments of the invention have been described in detail herein, those skilled in the art will also recognize that various substitutions and modifications may be made without departing from the scope and the spirit of the appended claims.

What is claimed is:

1. A multi-story, multiple dwelling unit building complex comprising:

at least one vehicle storage level comprising a plurality of at least one of vehicle parking spaces and private vehicle garages;

at least one elevator arranged to provide pedestrian access between said elevator and said storage level;

plural dwelling unit levels vertically spaced from each other and from said storage level and including at least one dwelling unit thereon, respectively, said elevator extending to at least selected ones of said dwelling unit levels; and each of said dwelling units having direct access to an elevator for providing a pathway between each of said dwelling units and said storage level whereby occupants of each of said dwelling units may have access to one of a vehicle parking space and a private garage associated with respective ones of said dwelling units by way of a pathway from each dwelling unit to each of said one of parking spaces and garages via said elevator.

2. The building complex set forth in claim 1 including:

one of a stairway and an elevator extending between said storage level and said dwelling unit levels to provide an alternate pathway between each of said dwelling units and at least one of said storage level and a ground level for said building complex.

3. The building complex set forth in claim 2 including:

a service corridor on at least selected ones of said dwelling unit levels and at least one of a doorway and stairway between each dwelling unit on said selected ones of said dwelling unit levels for access between said dwelling units and said service corridor, respectively.

4. The building complex set forth in claim 3 wherein:

at least selected ones of said dwelling units include a service room accessible through said doorway between said dwelling units and said service corridor, said service room being provided with a second doorway which is lockable so that items to be delivered and picked up may be placed in said service room and accessed from said service corridor without allowing access from said service corridor to said dwelling unit.

5. The building complex set forth in claim 2 including:

a service elevator extending between at least selected ones of said dwelling unit levels to provide access to said service corridors on said selected dwelling unit levels.

6. The building complex set forth in claim 2 including:

at least two stairways extending between said dwelling unit levels and a street level of said building complex, said stairways being spaced apart from each other.

7. The building complex set forth in claim 1 wherein:

said storage level includes driveway means thereon and vehicle parking spaces accessible from said driveway means, and said storage level includes garages disposed interior of said driveway means from said parking spaces.

8. The building complex set forth in claim 7 wherein:

multiple garages are disposed back-to-back on said storage level.

9. The building complex set forth in claim 1 wherein:

said elevator opens to two dwelling units on at least one dwelling unit level of said building complex.

10. The building complex set forth in claim 1 including:

at least one elevator disposed so as to open into a corridor at said storage level.

11. The building complex set forth in claim 1 including:

at least one elevator foyer at said storage level and means forming a pedestrian doorway between said foyer and said storage level to provide pedestrian access between said elevator and said storage level.

12. The building complex set forth in claim 1 wherein:

said garages include a floor formed by one level, a ceiling formed by another level and spaced apart sidewalls, said floor, ceiling and sidewalls being formed as a concrete structure utilizing tunnel form construction.

13. The building complex set forth in claim 1 wherein:

at least one level of dwelling units includes multi-story dwelling units including a first story and a second story and a stairway interconnecting said stories.

14. The building complex set forth in claim 1 wherein:

said building complex comprises at least one module characterized by a first level of multiple dwelling units extending from one sidewall of said building complex to an opposite sidewall of said building complex;

a second level of said module including multiple dwelling units occupying at least part of said second level and living spaces for said dwelling units of said first level occupying at least a portion of said second level; and a third level of said module including multiple dwelling units thereon.

15. The building complex set forth in claim 14 including:

a central corridor on said second level of said module and doorways opening into said corridor from each of said dwelling units on said first level, said second level and said third level.

16. The building complex set forth in claim 15 wherein:

said building complex includes plural elevators extending between said storage level and said dwelling unit levels, respectively, at least selected ones of said elevators opening to only selected ones of said dwelling units on selected ones of said dwelling unit levels.

17. A multi-story, multiple dwelling unit building complex comprising:

at least one multi-story module comprising a first level including multiple dwelling units thereon and extending between one sidewall of said module and an opposite sidewall of said module;

a second level of said module above said first level including plural dwelling units thereon and occupying at least a portion of said second level, at least selected ones of said dwelling units on said second level being separate from any other dwelling unit of said building complex;

a third level of said module above said second level including multiple dwelling units disposed thereon;

a corridor formed only on said second level; and respective separate pedestrian pathways extending between said corridor and each of said dwelling units on said first level, respective separate pedestrian pathways extending between said corridor and each of said dwelling units on said second level and respective separate pedestrian pathways extending between said corridor and each of said dwelling units on said third level to provide for access between said corridor and each of said dwelling units on each of said levels, respectively, without passing through another dwelling unit.

18. The building complex set forth in claim 17 including:

at least one stairway between said corridor and a ground level of said building complex.

19. A multi-story, multiple dwelling unit building complex comprising:

at least one vehicle parking level including plural private garages formed thereon and disposed back to back, each of said garages having a doorway between said garage and an elevator entrance at said one vehicle parking level;

multiple dwelling unit levels, each of said dwelling unit levels including at least one residential dwelling unit thereon; and elevator means extending between said one vehicle parking level and opening directly into said at least one dwelling unit at selected ones of said dwelling unit levels whereby persons occupying dwelling units on any one of said selected dwelling unit levels are provided a pathway directly from a selected garage to that person's dwelling unit by way of said elevator means.

20. The building complex set forth in claim 19 wherein:

said multiple dwelling unit levels are disposed vertically spaced from each other and vertically spaced above multiple vehicle parking levels.

21. The building complex set forth in claim 20 wherein:

said elevator means extends between each of said dwelling units and each of said vehicle parking levels to provide pedestrian access to each of said dwelling unit levels and each of said vehicle parking levels.

22. The building complex set forth in claim 19 including:

a service corridor on at least a selected one of said dwelling unit levels and one of a doorway and stairway between each dwelling unit on said selected one of said dwelling unit levels and said corridor for pedestrian access between said dwelling units and said service corridor, respectively.

23. The building complex set forth in claim 22 wherein:

at least selected ones of said dwelling units each include a service room accessible through said doorway between said dwelling units and said service corridor, respectively, said service room being provided with a second doorway which is lockable so that items to be delivered and picked up may be placed in said service room and accessed from said service corridor without allowing access from said service corridor to said dwelling unit.

24. The building complex set forth in claim 22 including:

a service elevator extending between at least selected ones of said dwelling unit levels to provide access to said service corridor on said selected dwelling unit levels, respectively.

25. The building complex set forth in claim 22 including:

at least one stairway extending between said dwelling unit levels and a street level of said building complex.

26. The building complex set forth in claim 19 including:

a pedestrian corridor interposed said back-to-back disposed garages.

27. The building complex set forth in claim 19 wherein:

said garages include a floor formed by one level, a ceiling formed by another level and spaced apart sidewalls, said floor, ceiling and sidewalls being formed as a concrete structure utilizing tunnel form construction.

28. The building complex set forth in claim 19 including:

at least two elevators disposed so as to open to said vehicle parking level.

29. The building complex set forth in claim 19 wherein:

said elevator means opens to two dwelling units on at least one dwelling unit level of said building complex.

30. The building complex set forth in claim 19 wherein:

one dwelling unit level of said building complex includes a dwelling unit which includes a portion thereof which occupies at least part of a second dwelling unit level.

31. The building complex set forth in claim 30 including:

a stairway extending between said dwelling unit on said one dwelling unit level and said portion of said dwelling unit on said second dwelling unit level.

32. The building complex set forth in claim 31 including:

a corridor extending along said second dwelling unit level and a doorway between said corridor and said portion of said dwelling unit.

33. The building complex set forth in claim 32 including:

a stairway between a third dwelling unit level and said second dwelling unit level and opening to said corridor.

34. The building complex set forth in claim 19 wherein:

said building complex is configured in multiples of three story dwelling unit modules including plural dwelling units on each level of each module.

35. The building complex set forth in claim 19 including:

a central corridor extending between respective sets of said back-to-back garages and providing a pedestrian path between said elevator means and said garages, respectively.

36. A multi-story, multiple dwelling unit building complex comprising:

at least one multi-story module comprising a first level including at least one dwelling unit thereon and extending between one sidewall of said module and an opposite sidewall of said module;

a second level of said module including at least one dwelling unit thereon and occupying at least a portion of said second level;

a third level of said module including at least one dwelling unit thereon;

said second level being disposed between said first level and said third level;

a corridor formed only on said second level; and respective separate pedestrian pathways between said corridor and said first level, between said corridor and said second level and between said corridor and said third level to provide for access between said corridor and each of said dwelling units on each of said levels without passing through another dwelling unit.

37. The building complex set forth in claim 36 wherein:

said at least one dwelling unit on said first level includes a portion thereof on said second level.

38. The building complex set forth in claim 37 wherein:

said pathway between said first level and said corridor includes a stairway between said first level and said second level within said at least one dwelling unit on said first level.

39. The building complex set forth in claim 38 wherein:

said module includes multiple dwelling units on said first level, each including a portion thereof on said second level and respective stairways within each of said multiple dwelling units between said first and second levels.

40. The building complex set forth in claim 36 wherein:

said pathway between said third level and said corridor comprise a stairway between said dwelling unit on said third level and said corridor.

41. The building complex set forth in claim 40 wherein:

said module includes multiple dwelling units on said third level and stairways between each of said multiple dwelling units and said corridor.

42. The building complex set forth in claim 36 including:

at least one stairway between said corridor and a ground level of said building complex.

43. A multi-story, multiple dwelling unit building complex comprising:

at least one multi-story module comprising a first level including at least one dwelling unit thereon and extending between one sidewall of said module and an opposite sidewall of said module;

a second level of said module including at least one dwelling unit thereon and occupying a portion of said second level;

a corridor formed on said second level and respective pathways between said corridor and said first level and said second level to provide for access between said corridor and each of said dwelling units on each of said levels;

at least one vehicle parking level including plural private garages formed thereon, each of said garages having a doorway between said garage and an elevator entrance at said vehicle parking level; and elevator means extending between said vehicle parking level and opening directly into said at least one dwelling unit at each level whereby persons occupying said dwelling units are provided a pathway directly from a selected garage to that person's dwelling unit by way of said elevator means.

* * * * *